US009785088B2

(12) United States Patent
Eto

(10) Patent No.: US 9,785,088 B2
(45) Date of Patent: Oct. 10, 2017

(54) IMAGE FORMING APPARATUS INCLUDING DEVELOPER CONTAINER, AND THE DEVELOPER CONTAINER

(71) Applicant: KYOCERA Document Solutions Inc., Osaka-shi, Osaka (JP)

(72) Inventor: Daisuke Eto, Osaka (JP)

(73) Assignee: KYOCERA Documents Solutions Inc. (JP)

( * ) Notice: Subject to any disclaimer, the term of this patent is extended or adjusted under 35 U.S.C. 154(b) by 0 days.

(21) Appl. No.: 15/138,243

(22) Filed: Apr. 26, 2016

(65) Prior Publication Data

US 2016/0313672 A1 Oct. 27, 2016

(30) Foreign Application Priority Data

Apr. 27, 2015 (JP) ..... 2015-090230

(51) Int. Cl.
*G03G 15/08* (2006.01)
*G03G 21/16* (2006.01)

(52) U.S. Cl.
CPC ..... *G03G 15/0886* (2013.01); *G03G 21/1676* (2013.01)

(58) Field of Classification Search
CPC ..... G03G 15/0886
USPC ..... 399/258, 114, 110, 111, 119
See application file for complete search history.

(56) References Cited

U.S. PATENT DOCUMENTS

2005/0175373 A1* 8/2005 Okamoto ..... G03G 15/0121 399/119
2006/0013621 A1 1/2006 Kimura et al.
2007/0104505 A1* 5/2007 Murakami ..... G03G 15/0872 399/106
2008/0025764 A1 1/2008 Kimura et al.
2009/0290911 A1 11/2009 Kimura et al.
2011/0020014 A1* 1/2011 Okamoto ..... G03G 15/0881 399/12
2011/0052269 A1 3/2011 Kimura et al.
(Continued)

FOREIGN PATENT DOCUMENTS

JP 2002-268356 9/2002
JP 2004-258472 9/2004
JP 2006-30569 2/2006

*Primary Examiner* — Walter L Lindsay, Jr.
*Assistant Examiner* — Arlene Heredia Ocasio
(74) *Attorney, Agent, or Firm* — Gerald E. Hespos; Michael J. Porco; Matthew T. Hespos

(57) ABSTRACT

An image forming apparatus includes an image carrier, a developing roller, a transfer section, a developer container, and a main unit. The image carrier has a surface for allowing an electrostatic latent image to be formed thereon, and carries a developed image. The developer container includes a container body having a side wall extending in a first direction, a container shutter, and a developer discharge port. The container shutter covers or exposes the developer discharge port. The main unit includes a housing and a guide mechanism. The developer container is mounted into the mounting section while being guided by the guide mechanism, and subsequently the container body of the developer container is rotated in a first rotational direction so that the developer discharge port communicates with the developer supply port and the side wall of the developer container is oblique to the vertical plane at an angle.

14 Claims, 26 Drawing Sheets

(56) References Cited

U.S. PATENT DOCUMENTS

| | | | | |
|---|---|---|---|---|
| 2011/0229192 | A1* | 9/2011 | Okamoto | G03G 21/1623 399/110 |
| 2012/0076550 | A1 | 3/2012 | Kimura et al. | |
| 2012/0275820 | A1* | 11/2012 | Eto | G03G 21/1842 399/110 |
| 2013/0259535 | A1 | 10/2013 | Kimura et al. | |
| 2014/0227009 | A1 | 8/2014 | Kimura et al. | |
| 2015/0168872 | A1 | 6/2015 | Kimura et al. | |
| 2016/0054682 | A1* | 2/2016 | Inui | G03G 15/0886 399/111 |

* cited by examiner

IMAGE FORMING APPARATUS INCLUDING DEVELOPER CONTAINER, AND THE DEVELOPER CONTAINER

INCORPORATION BY REFERENCE

This application is based on Japanese Patent Application No. 2015-090230 filed with the Japan Patent Office on Apr. 27, 2015, the contents of which are hereby incorporated by reference.

BACKGROUND

The present disclosure relates to an image forming apparatus including a developer container, and the developer container.

Conventionally, toner supply containers are known as developer containers for containing developer. After a toner supply container is mounted in a specific apparatus body, a rotary lever is rotated to cause a shutter to slide. As a result, a discharge port of the toner supply container is exposed to allow discharge of toner.

Further, there is known a technology of allowing a toner cartridge (developer container) to push and slide a shutter member when the toner cartridge is mounted into an apparatus body in one direction.

SUMMARY

An image forming apparatus according to an aspect of the present disclosure includes a casing, an image carrier, an exposure device, a developing roller, a transfer section, a developer container, and a main unit. The image carrier has a surface for allowing an electrostatic latent image to be formed thereon, and carries a developed image. The exposure device forms the elastic latent image on the image carrier. The developing roller supplies developer to the image carrier. The transfer section transfers the developed image from the image carrier onto a sheet. The developer container contains the developer. The main unit is disposed in the casing, includes a mounting section for allowing the developer container to be mounted therein, and receives the developer supplied from the developer container. The developer container includes a container body having a side wall extending in a first direction, and a container shutter. The container body is formed with a developer discharge port. The container shutter is supported on the container body slidably with respect to the developer discharge port, and covers or exposes the developer discharge port. The main unit includes a housing and a guide mechanism. The housing is formed with a developer supply port facing the developer container and communicating with an inside of the housing. The guide mechanism guides the mounting of the developer container into the mounting section. The developer container is mounted into the mounting section while being guided in a second direction intersecting the side wall by the guide mechanism, and subsequently the container body of the developer container is rotated in a first rotational direction around an axis extending in the first direction to thereby move and expose the developer discharge port away from the container shutter so that the developer discharge port communicates with the developer supply port. The second direction refers to a direction extending obliquely downward to a vertical plane at a first angle. The first rotational direction refers to a direction in which the developer discharge port rotates downward. When the developer discharge port communicates with the developer supply port as a result of the rotation of the developer container in the first rotational direction, the side wall of the developer container is oblique to the vertical plane at a second angle smaller than the first angle.

A developer container according to another aspect of the present disclosure is mounted into the main unit of the above-described image forming apparatus. The developer container includes a mounting guide member and a shutter guide member. The mounting guide member is disposed on the container, extends in the second direction, and is engageable with the guide mechanism. The shutter guide member is disposed on the container body and supports the container shutter in such a manner as to allow the container shutter to slide around the axis.

These and other objects, features and advantages of the present disclosure will become more apparent upon reading the following detailed description along with the accompanying drawings.

DETAILED DESCRIPTION

Hereinafter, an embodiment of the present disclosure will be described with reference to the accompanying drawings.

Figure 1:
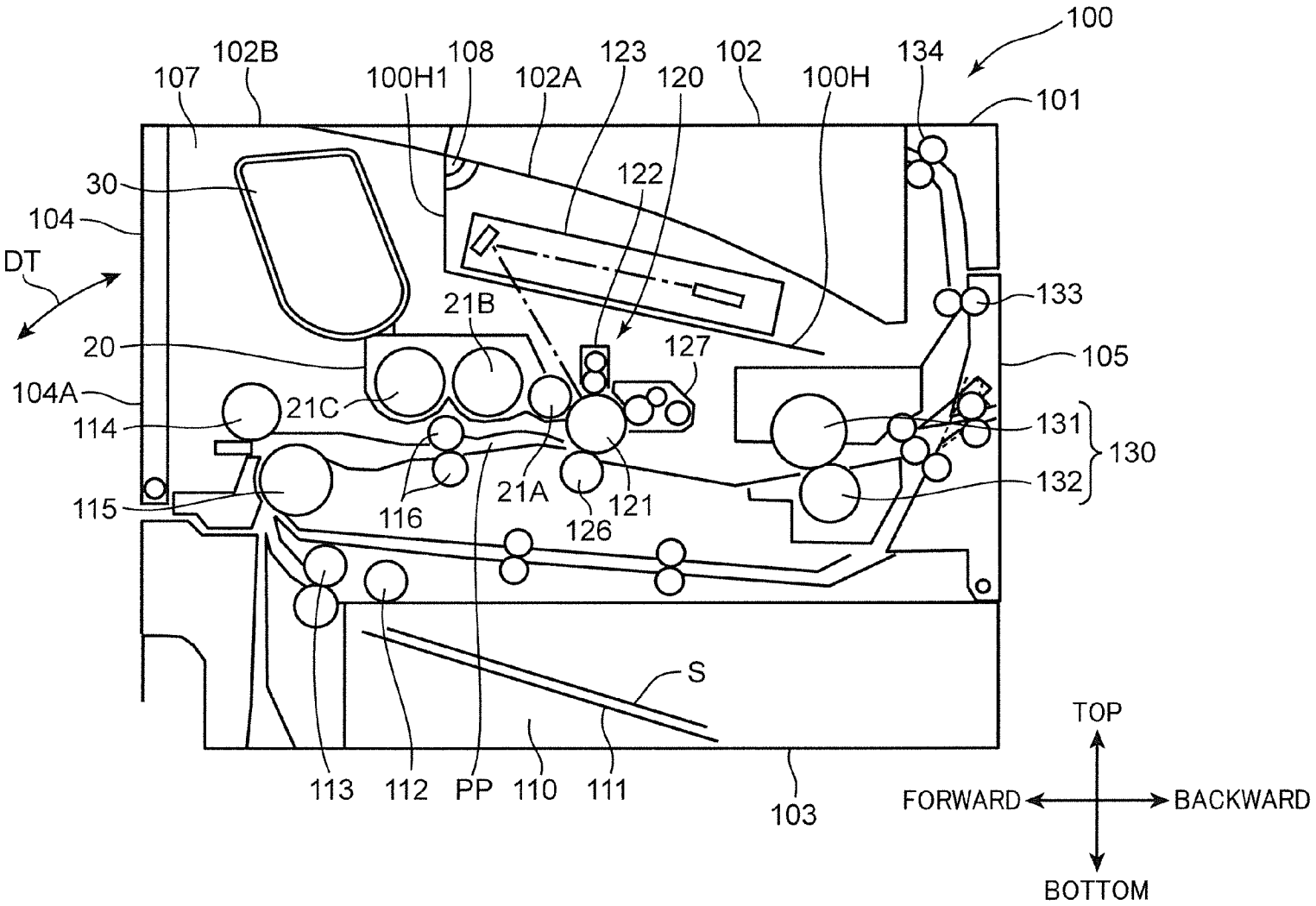
FIG. 1 is a sectional view showing an internal structure of an image forming apparatus according to an embodiment of the present disclosure.

FIG. 1 is a sectional view showing an internal structure of a printer 100 (image forming apparatus) according to an embodiment of the present disclosure. The printer 100 shown in FIG. 1, which exemplifies the image forming apparatus, is configured as a so-called monochrome printer. However, other apparatuses may alternatively be provided as the image forming apparatus in other embodiments, such as a color printer, a facsimile apparatus or a multifunctional apparatus equipped with these functions, or another type of apparatus for forming a toner image on a sheet. It should be noted that hereinafter, terms indicating directions such as "top" "bottom" "forward" "backward" "left" and "right" are intended merely for descriptive purposes, and not for limiting the principle of the image forming apparatus.

The printer 100 includes a casing 101 for housing various components that are used for forming an image on a sheet S. The casing 101 includes a top wall 102 defining the top surface of the casing 101, a bottom wall 103 defining the bottom surface of the casing 101, a main body rear wall 105 connecting the top wall 102 and the bottom wall 103, and a main body front wall 104 located in front of the main body rear wall 105. The casing 101 includes a main body internal space 107 where various components are placed. A sheet conveyance passage PP extends in the main body internal space 107 of the casing 101, and allows passage of a sheet S in a predetermined conveying direction.

A sheet discharge section 102A is disposed in a central portion of the top wall 102. The sheet discharge section 102A includes an oblique surface sloping downward from a front end to a rear end of the top wall 102. A sheet S that has been subjected to image formation in an image forming section 120 described later is discharged onto the sheet discharge section 102A. Further, a manual feed tray 104A (see FIG. 16) is disposed in the main body front wall 104. The manual feed tray 104A is vertically pivotable with a lower end thereof acting as a fulcrum (as shown by the arrow DT in FIG. 1).

With reference to FIG. 1, the printer 100 includes a cassette 110, a pickup roller 112, a first sheet feeding roller 113, a second sheet feeding roller 114, a conveying roller 115, a pair of registration rollers 116, the image forming section 120, and a fixing device 130.

The cassette 110 stores sheets S. The cassette 110 includes a lift plate 111. The lift plate 111 is tilted to lift the leading edges of the sheets S. The cassette 110 can be pulled out forwardly with respect to the casing 101.

The pickup roller 112 is disposed above the leading edges of sheets S lifted by the lift plate 111. The pickup roller 112 rotates to draw a sheet S from the cassette 110. The first sheet feeding roller 113 is disposed downstream of the pickup roller 112 and conveys a sheet S further downstream. The second sheet feeding roller 114 is disposed at the inner side (rear side) of the fulcrum of the manual feed tray 104A and draws a sheet placed on the manual feed tray 104A into the casing 101.

The conveying roller 115 is disposed downstream of the first sheet feeding roller 113 and the second sheet feeding roller 114 in the sheet conveying direction (hereinafter, the sheet conveying direction also being simply referred to as "conveying direction") and conveys a sheet S further downstream. The pair of registration rollers 116 functions to correct the angle of a sheet S that has been obliquely conveyed. Thus, it is possible to adjust the position of an image to be formed on the sheet S. The pair of registration rollers 116 supplies the sheet S to the image forming section 120 in accordance with the timing of image formation to be performed by the image forming section 120.

The image forming section 120 includes a photoconductive drum 121 (image carrier), a charger 122, an exposure device 123, a developing device 20, a toner container 30 (developer container), a transferring roller 126 (transfer section), and a cleaning device 127.

The photoconductive drum 121 is in the form of a cylinder. The photoconductive drum 121 has a surface to be formed with an electrostatic latent image, and carries a toner image (developed image) corresponding to the electrostatic latent image on the surface. The charger 122 is applied with a predetermined voltage, and charges the circumferential surface of the photoconductive drum 121 substantially uniformly.

The exposure device 123 irradiates the circumferential surface of the photoconductive drum 121 charged by the charger 122 with beams of laser light. The beams of laser light are emitted in accordance with image data output from an external device (not shown) such as a personal computer which is communicably connected to the printer 100. Consequently, the circumferential surface of the photoconductive drum 121 is formed with an electrostatic latent image corresponding to the image data. As shown in FIG. 1, the exposure device 123 is supported on a support frame 100H. The support frame 100H is disposed in the casing 101. The support frame 100H includes a frame front wall 100H1 (wall portion). The frame front wall 100H1 stands in a vertical position at a front end of the support frame 100H.

The developing device 20 supplies toner to the circumferential surface of the photoconductive drum 121 formed with an electrostatic latent image. The toner container 30 supplies toner to the developing device 20. The toner container 30 is detachably mounted on the developing device 20. The developing device 20 supplies the toner to the photoconductive drum 121 to develop (visualize) the electrostatic latent image formed on the circumferential surface of the photoconductive drum 121. Consequently, the circumferential surface of the photoconductive drum 121 is formed with a toner image (developed image).

The transferring roller 126 defines a transfer nip in cooperation with the photoconductive drum 121 and transfers a toner image onto a sheet S. The cleaning device 127 removes, after a toner image is transferred onto a sheet S from the circumferential surface of the photoconductive drum 121, toner remaining on the circumferential surface.

The fixing device 130 is disposed downstream of the image forming section 120 in the conveying direction, and fixes a toner image on a sheet S. The fixing device 130 includes a heating roller 131 for melting toner on the sheet S, and a pressure roller 132 for bringing the sheet S into close contact with the heating roller 131.

The printer 100 further includes a pair of conveying rollers 133 disposed downstream of the fixing device 130, and a pair of discharge rollers 134 disposed downstream of the pair of conveying rollers 133. A sheet S is conveyed upward by the pair of conveying rollers 133 to be finally discharged from the casing 101 by the pair of discharge rollers 134. The sheet S discharged from the casing 101 is placed on the sheet discharge section 102A, thereby resulting in a stack of sheets.

<Developer Container and Developing Device>

Figure 2A:
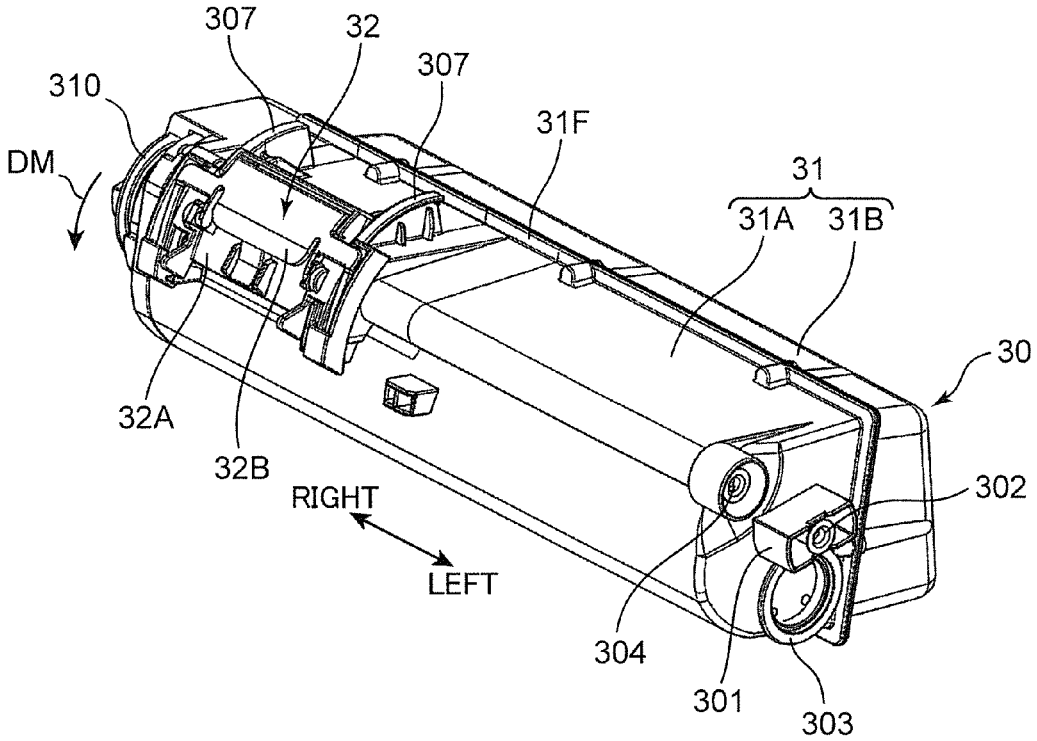
FIG. 2A is a perspective view of a developer container according to the embodiment of the present disclosure.
Figure 2B:
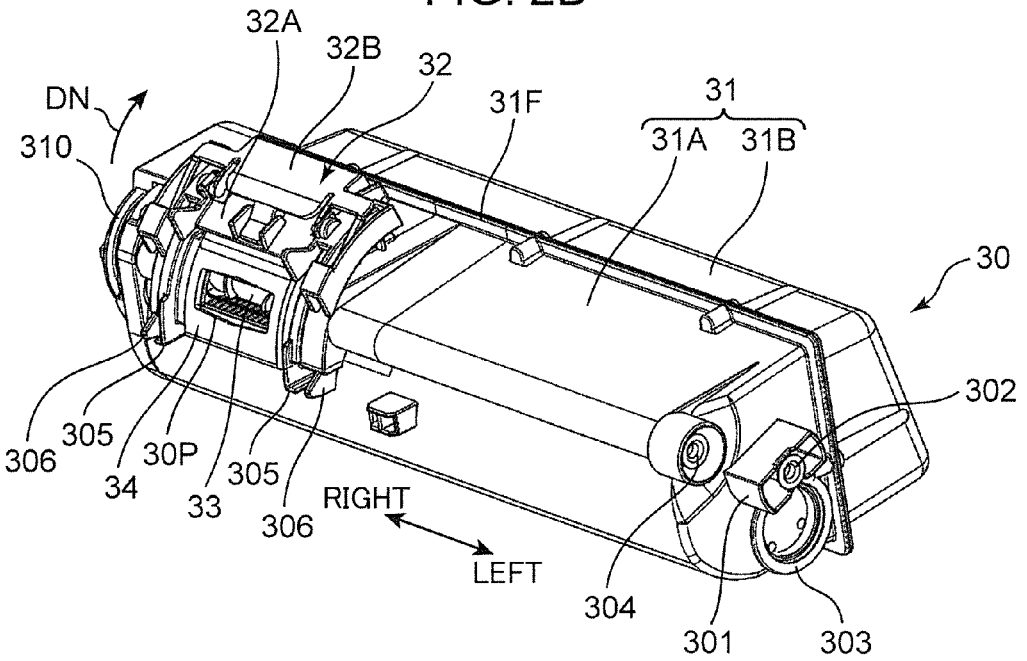
FIG. 2B is a perspective view of the developer container according to the embodiment of the present disclosure.
Figure 3A:
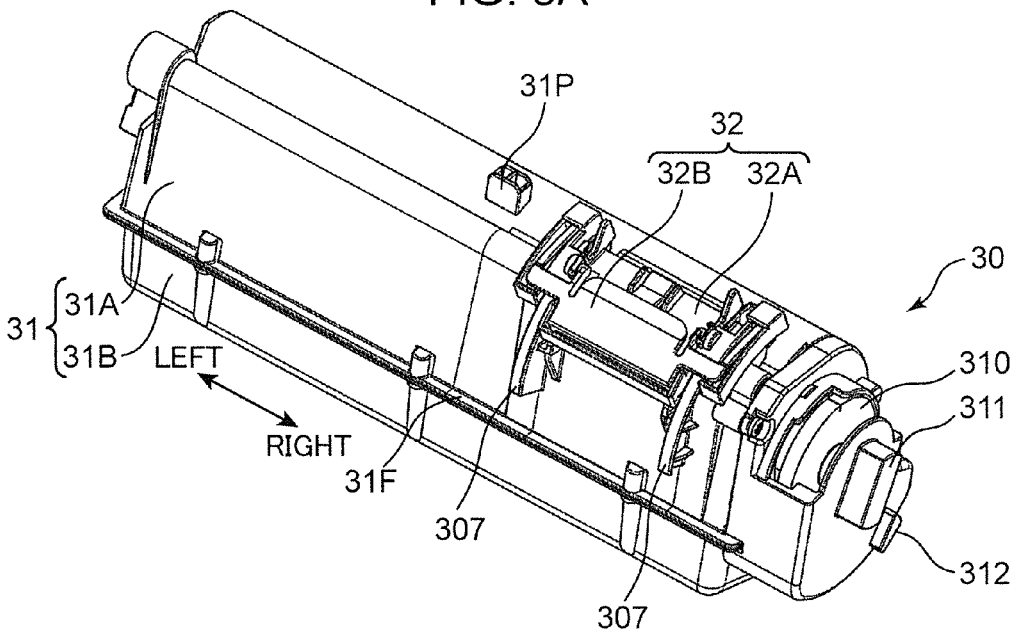
FIG. 3A is a perspective view of the developer container according to the embodiment of the present disclosure.
Figure 3B:
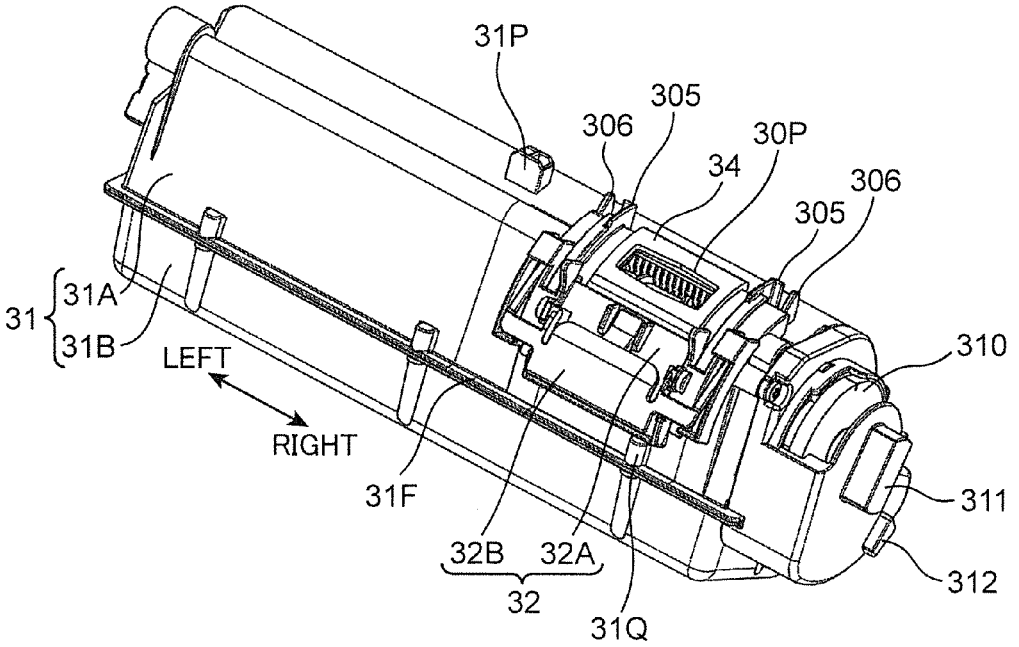
FIG. 3B is a perspective view of the developer container according to the embodiment of the present disclosure.
Figure 4A:
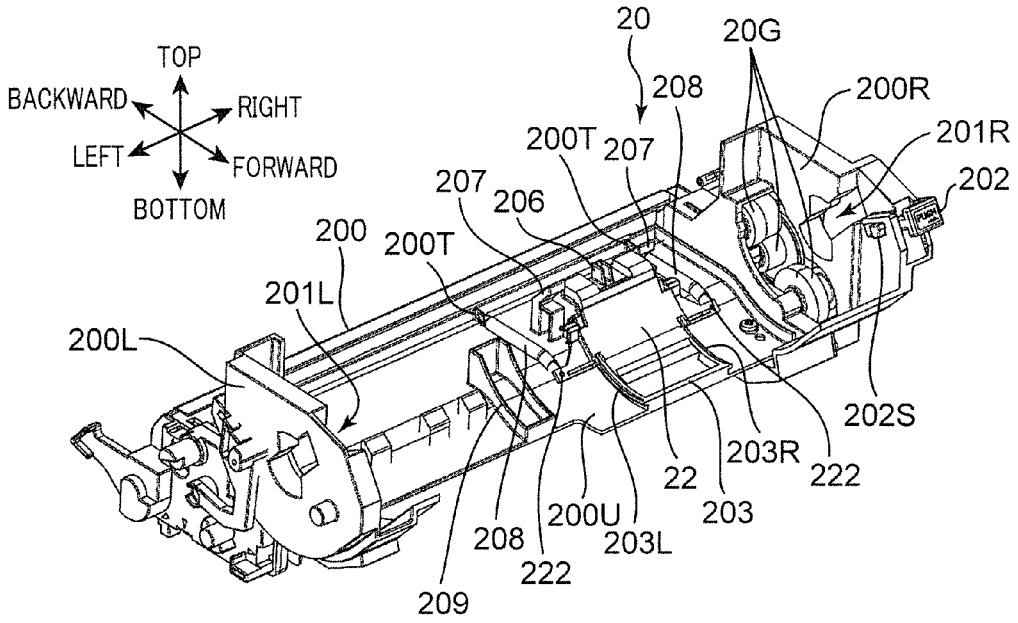
FIG. 4A is a perspective view of a main unit according to the embodiment of the present disclosure.
Figure 4B:
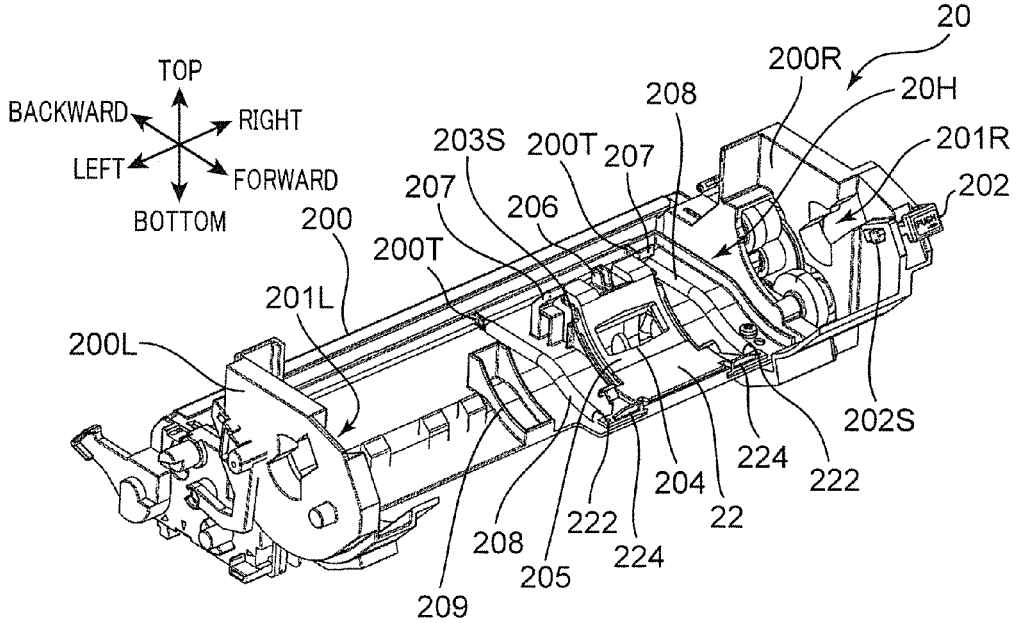
FIG. 4B is a perspective view of the main unit according to the embodiment of the present disclosure.
Figure 5A:
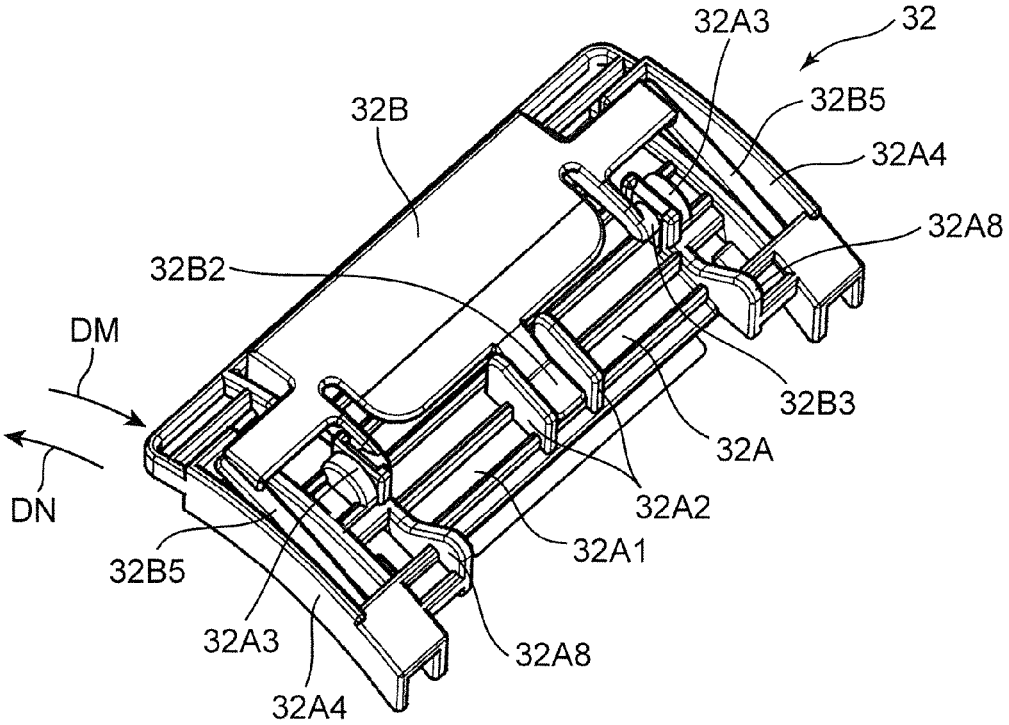
FIG. 5A is a perspective view of a container shutter according to the embodiment of the present disclosure.
Figure 5B:
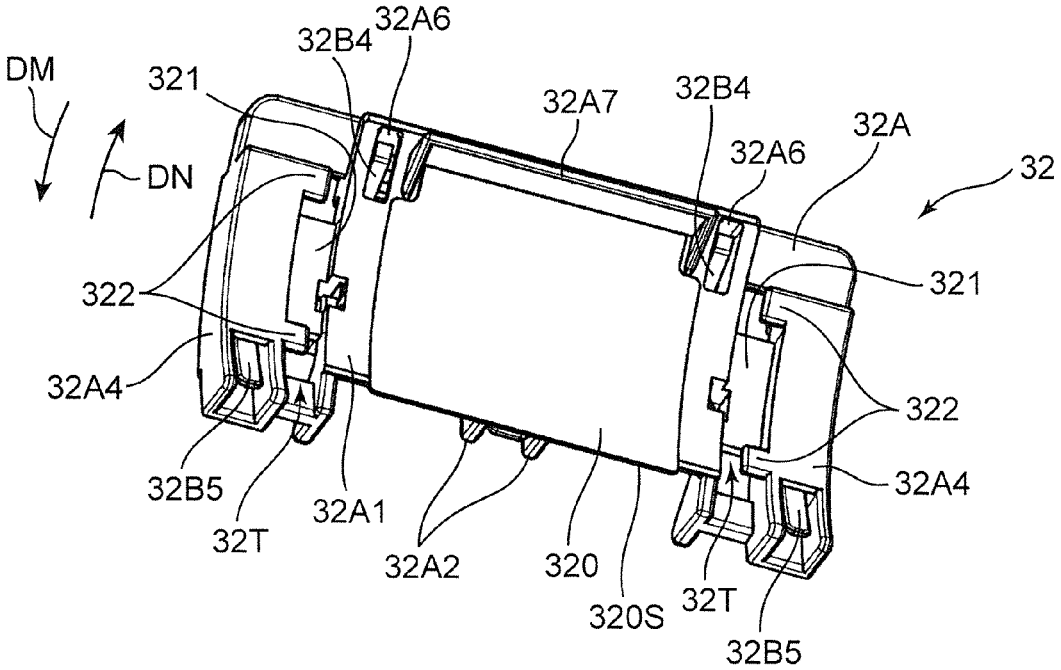
FIG. 5B is a perspective view of the container shutter according to the embodiment of the present disclosure.
Figure 6A:
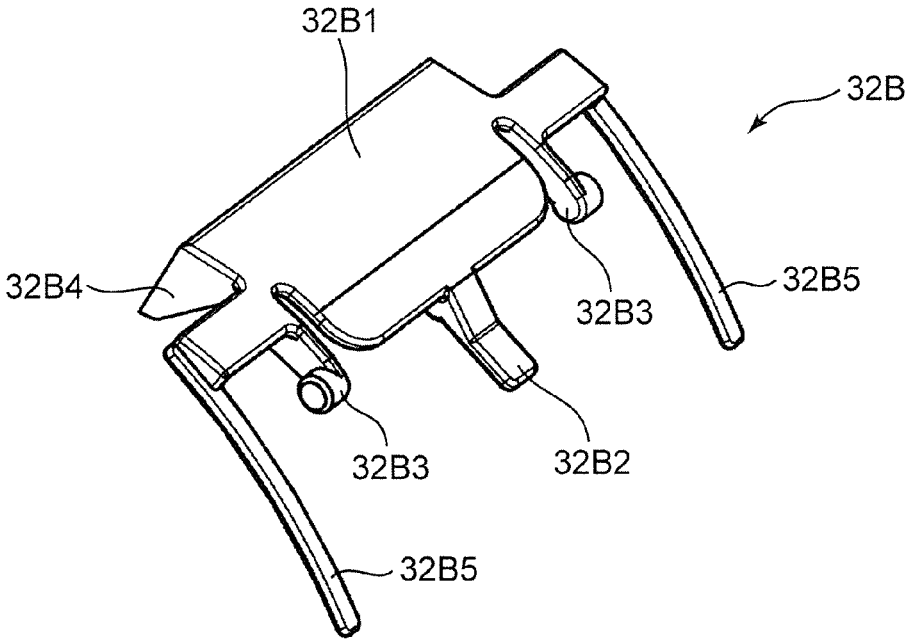
FIG. 6A is a perspective view of a part of the container shutter according to the embodiment of the present disclosure.
Figure 6B:
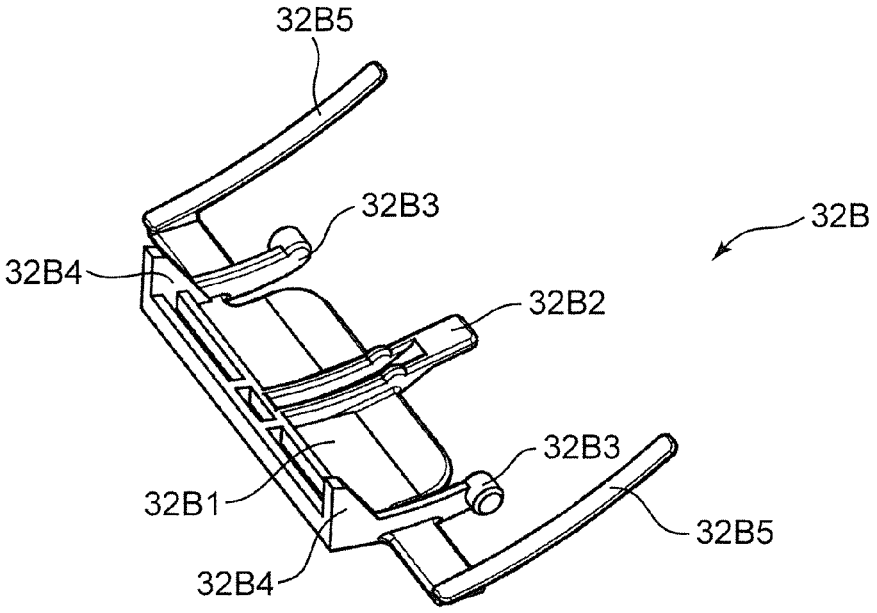
FIG. 6B is a perspective view of the part of the container shutter according to the embodiment of the present disclosure.
Figure 7A:
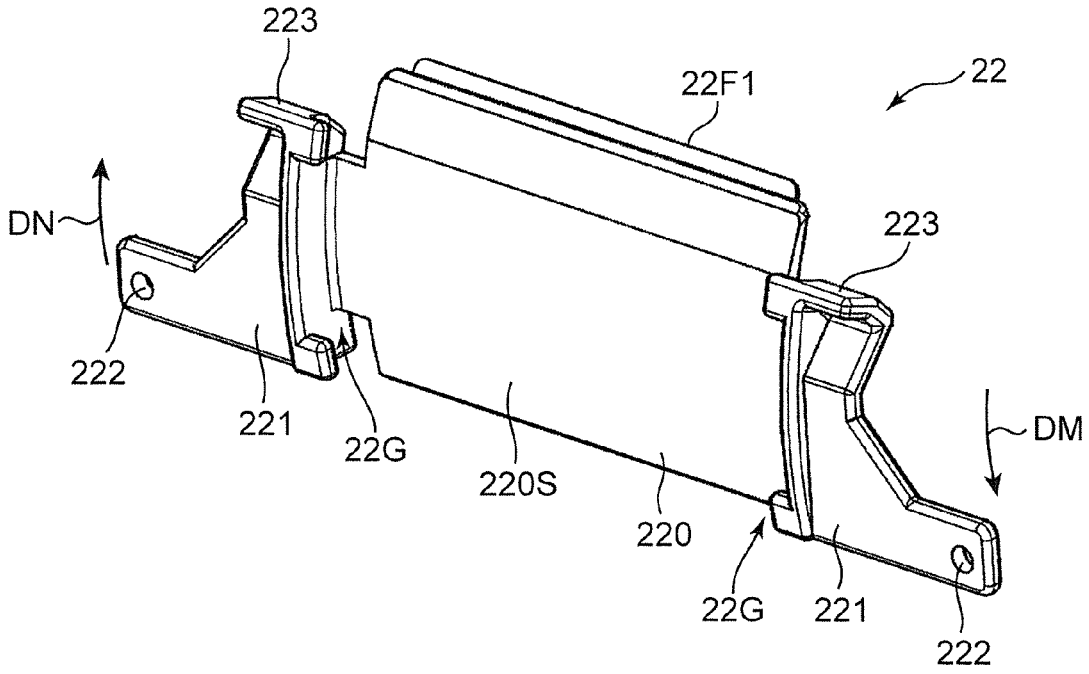
FIG. 7A is a perspective view of a main unit shutter according to the embodiment of the present disclosure.
Figure 7B:
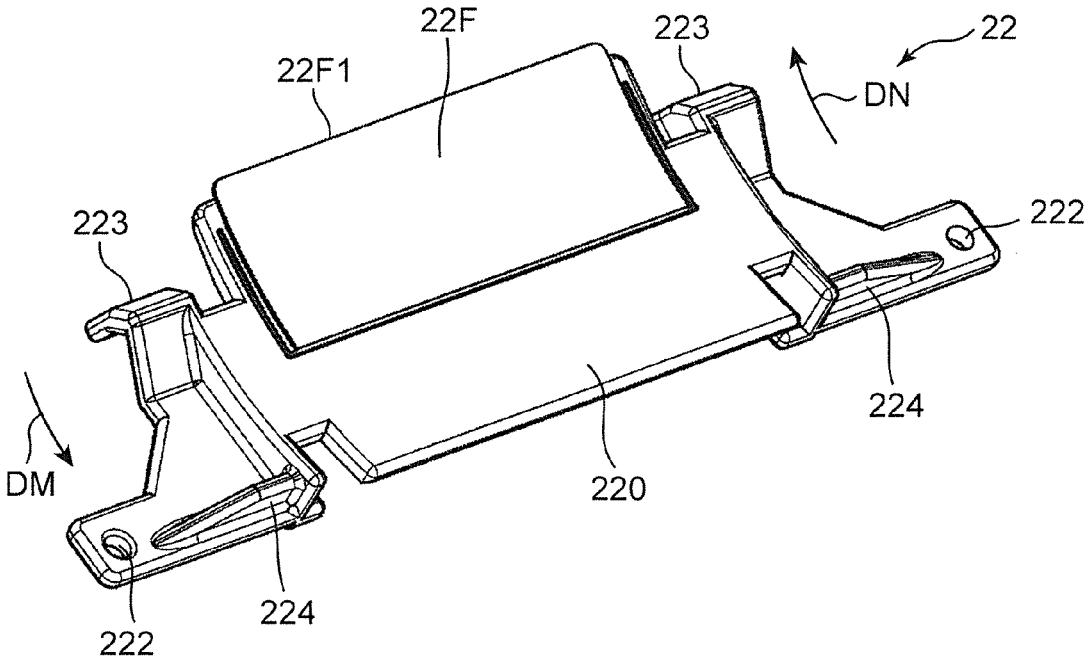
FIG. 7B is a perspective view of the main unit shutter according to the embodiment of the present disclosure.
Figure 8:
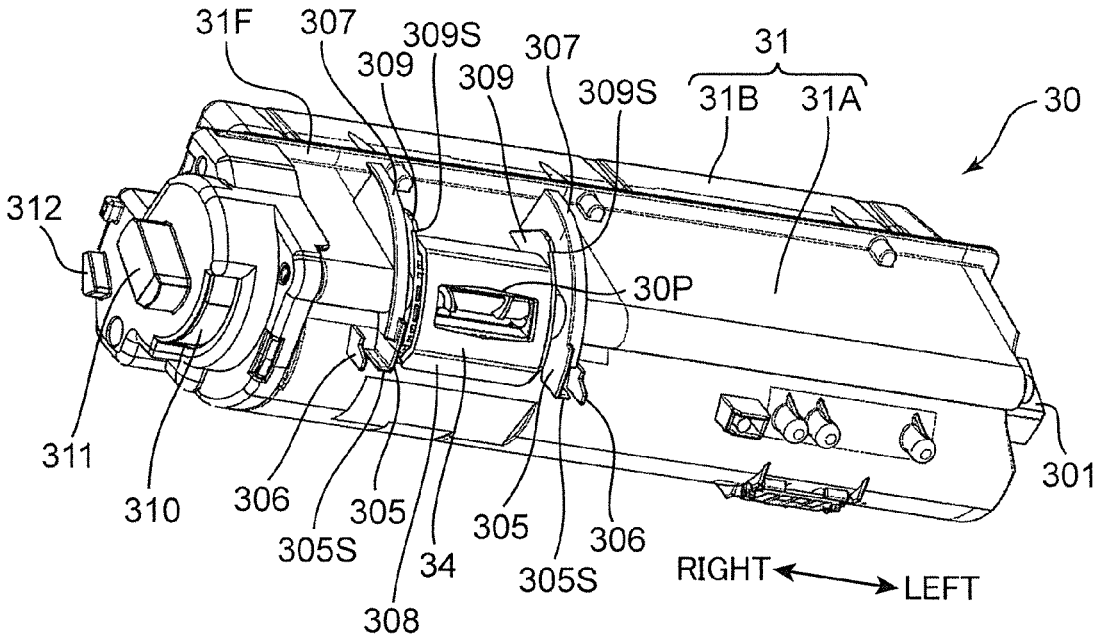
FIG. 8 is a perspective view of the developer container according to the embodiment of the present disclosure, with the container shutter detached.

Now the toner container 30 (developer container) and the developing device 20 (main unit) according to the present embodiment will be further described in detail with reference to FIGS. 2A to 8. FIGS. 2A, 2B, 3A and 3B are perspective views of the toner container 30 according to the present embodiment, FIGS. 2A and 3A showing a toner discharge port 30P covered by a container shutter 32 as described later, and FIGS. 2B and 3B showing the toner discharge port 30P being exposed. Further, FIGS. 4A and 4B are perspective views of a development housing 200 of the developing device 20 according to the present embodiment, FIG. 4A showing a toner supply port 204 covered by a main unit shutter 22 as described later, and FIG. 4B showing the toner supply port 204 being exposed. Further, FIGS. 5A and 5B are perspective views of the container shutter 32, FIG. 5A showing the container shutter 32 as seen from the outside of the toner container 30, and FIG. 5B showing the container shutter 32 as seen from the inside of the toner container 30. Further, FIGS. 6A and 6B are perspective views of a part (a shutter stopper 32B) of the container shutter 32 according to the present embodiment. Further, FIGS. 7A and 7B are perspective views of the main unit shutter 22 according to the present embodiment, FIG. 7A showing the main unit shutter 22 as seen from the inside of the developing device 20, and FIG. 7B showing the main unit shutter 22 as seen from the outside of the developing device 20. Further, FIG. 8 is a perspective view of the toner container 30 with the container shutter 32 detached. In the present embodiment, the toner container 30 and a part (such as the development housing 200) of the developing device 20 constitute a developer supplier.

The toner container 30 contains toner (developer). The toner container 30 has a longer dimension in one direction (first direction). The toner container 30 is mounted into the developing device 20 disposed in the casing 101 in such a manner that the length of the toner container 30 extends in a right/left direction. The toner container 30 includes a container body 31 (container body), the container shutter 32 (container shutter), a container screw 33 (FIG. 2B), a container paddle 30K (see FIG. 11B), and a container seal 34 (FIG. 2B).

Figure 11A:
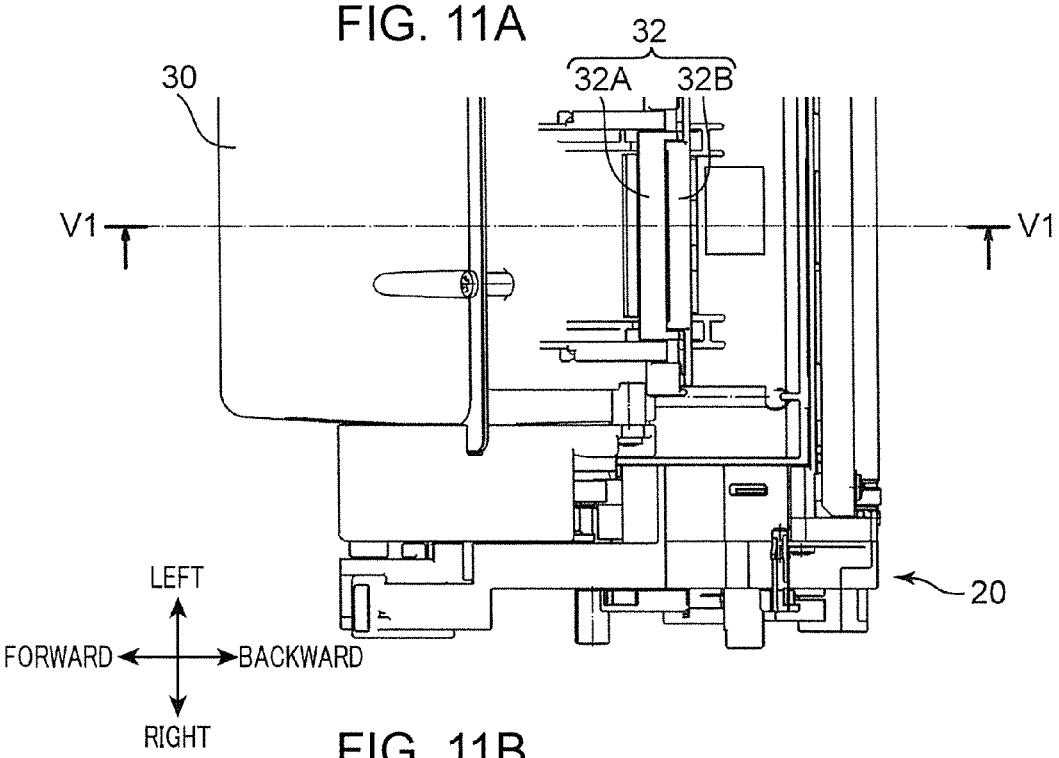
FIG. 11A is an enlarged plan view of the main unit and the developer container according to the embodiment of the present disclosure.
Figure 11B:
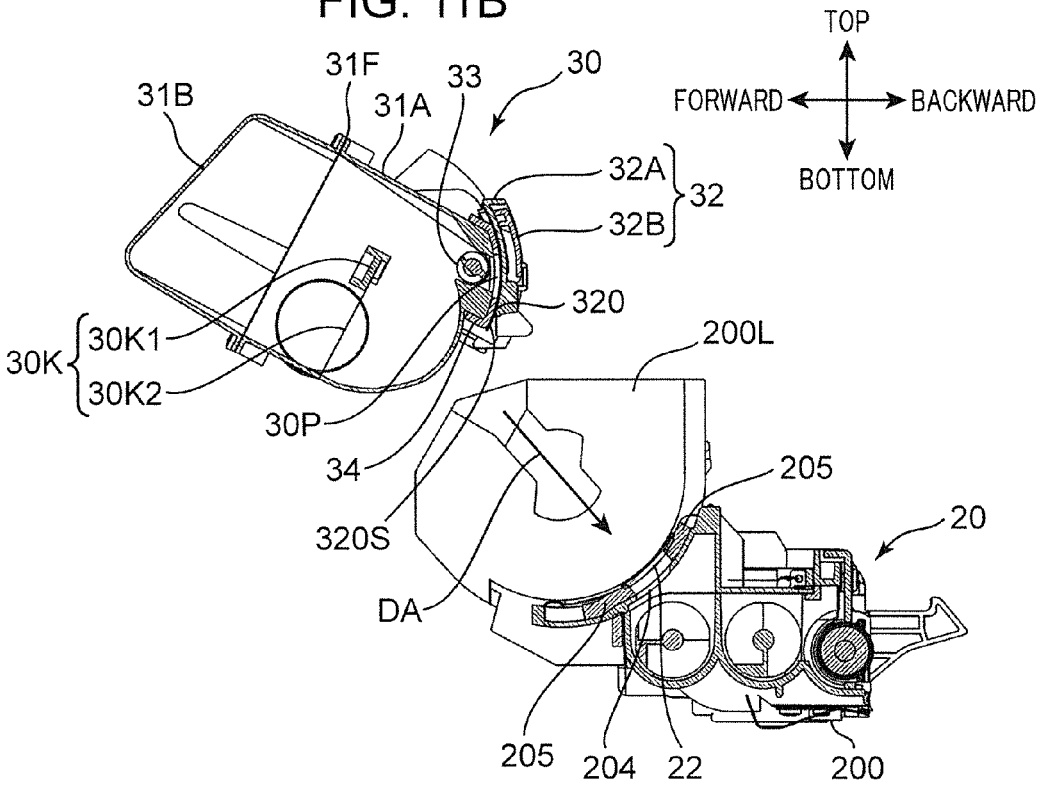
FIG. 11B is a sectional view illustrating the mounting of the developer container into the main unit in the embodiment of the present disclosure.

The container body 31 constitutes the body of the toner container 30. The container body 31 includes a body portion 31A and a lid portion 31B. The body portion 31A constitutes a lower portion of the container body 31. The body portion 31A is in the form of a cylinder having an opening extending in the longitudinal direction of the toner container 30, the opening being formed by cutting off a part of the circumferential portion of the cylinder. The lid portion 31B is attached to the opening of the body portion 31A, and defines a storage space for containing toner in cooperation with the body portion 31A. As shown in FIG. 11B, in sectional view perpendicularly intersecting the longitudinal direction of the toner container 30, the body portion 31A has a substantially U-shape and the lid portion 31B has a substantially trapezoid shape. Further, as shown in FIGS. 2A to 3B, the toner container 30 includes container flanges 31F (holder) at the joint between the body portion 31A and the lid portion 31B. The container flanges 31F are respectively provided on the body portion 31A and the lid portion 31B and are used for securing the lid portion 31B to the body portion 31A. After the container screw 33 described later and other components are placed in the body portion 31A of the toner container 30, the lid portion 31B is welded to the body portion 31A.

The toner container 30 further includes the toner discharge port 30P, a left guide 301 (mounting guide member), a paddle bearing 302, a filling port cap 303, a screw bearing 304, a pair of container shutter pushing portions 305 (FIG. 2B), a pair of elastic piece pushing portions 306 (FIG. 2B), a pair of guide ribs 307 (FIG. 2A) (shutter guide member), a discharge projection 308 (see FIG. 8), a pair of container shutter locking ribs 309 (see FIG. 8), a transmission gear 310 (FIGS. 2A and 3A), a right guide 311 (FIG. 3A) (mounting guide member), a lock pushing portion 312 (FIG. 3A), a central guide piece 31P, and an end contact portion 31Q (FIG. 3B).

The toner discharge port 30P is formed at the lower right end of the body portion 31A. Specifically, the toner discharge port 30P is formed in a substantially rectangular shape in an outer portion of the discharge projection 308 (FIGS. 8 and 11D), the discharge projection 308 projecting in a curve from a lower surface of the body portion 31A. Toner contained in the toner container 30 is discharged through the toner discharge port 30P and supplied to the developing device 20.

The left guide 301 is in the form of a rectangular projection disposed on the left surface of the body portion 31A and extending in a predetermined direction. The left guide 301 engages with a left guide groove 201L of the developing device 20 described later to be guided therealong. Consequently, a mounting direction (second direction or the direction of the arrow DA shown in FIG. 9A) in which the toner container 30 is mounted into the developing device 20 is restricted. It should be noted that the left guide 301 has an internal cavity. The paddle bearing 302 is disposed inside the left guide 301. The paddle bearing 302 axially supports a paddle shaft 30K1 of the container paddle 30K described later. The filling port cap 303 is disposed adjacent to the left guide 301, and seals an unillustrated filling port formed in the left end of the body portion 31A. When the toner container 30 is manufactured, toner is filled into the container body 31 through the filling port. The screw bearing 304 is disposed on the left surface of the body portion 31A and is adjacent to the left guide 301 on the opposite side from the filling port cap 303. The screw bearing 304 rotatably and axially supports the container screw 33 described later.

The container shutter pushing portions 305 (FIGS. 2B, 3B and 8) are in the form of a pair of projecting ribs, and sandwich the discharge projection 308 in the longitudinal direction (right/left direction) of the toner container 30, the discharge projection 308 being formed with the toner discharge port 30P. The container shutter pushing portions 305 are disposed downstream of the toner discharge port 30P in a rotational direction (first rotational direction or the direction of the arrow DM shown in FIG. 2A) in which the toner container 30 is mounted. The pair of container shutter pushing portions 305 each extend in the rotational direction and have respective distal ends (container shutter pushing pieces 305S) extending in the longitudinal direction of the toner container 30 (respectively extending in the right and left directions). The container shutter pushing portions 305 have functions to push the main unit shutter 22 and to be pushed by the main unit shutter 22.

The elastic piece pushing portions 306 (FIGS. 2B, 3B and 8)are in the form of a pair of projections extending from the body portion 31A and disposed adjacent to the container shutter pushing pieces 305S of the container shutter pushing portions 305. The pair of elastic piece pushing portions 306 sandwich the pair of container shutter pushing portions 305 in the right/left direction. The elastic piece pushing portions 306 each extend in the above-mentioned rotational direction of the toner container 30 and have such a stepped shape that the height of projection increases in a direction away from the toner discharge port 30P. The elastic piece pushing portions 306 have a function to push a pair of elastic pieces 32B5 of the shutter stopper 32B described later.

The pair of guide ribs 307 (FIGS. 2A, 3A and 8) project from the body portion 31A in a curve and respectively connect with the container shutter pushing portions 305. The guide ribs 307 extend in the rotational direction of the container body 31. The pair of guide ribs 307 sandwich the toner discharge port 30P in the right/left direction. Further, as shown in FIG. 8, the guide ribs 307 extend beyond the toner discharge port 30P in a direction away from the container shutter pushing pieces 305S such that respective distal ends are disposed near the container flanges 31F. Respective circumferential portions of the pair of guide ribs 307 are so bent as to have a predetermined width in the right/left direction. The guide ribs 307 support the container shutter 32 described later in such a manner as to allow the container shutter 32 to slide around a predetermined axis.

The pair of container shutter locking ribs 309 (FIG. 8) extend from the laterally opposite edges of the discharge projection 308 and have a shape corresponding to the circumference of the toner container 30. More specifically, the pair of container shutter locking ribs 309 extend from the laterally opposite edges of the discharge projection 308 in a rotational direction (second rotational direction or the direction of the arrow DN shown in FIG. 2B) in which the toner container 30 is dismounted from the developing device 20. The container shutter locking ribs 309 each have a stepped distal end (container shutter engaging portion 309S) (FIG. 8). The container shutter engaging portions 309S are respectively engageable with stopper locking pieces 32B4 of the shutter stopper 32B described later.

The transmission gear 310 (FIG. 3A) is rotatably supported on the right surface of the toner container 30. The transmission gear 310 has a function to transmit a torque to the container paddle 30K. When the toner container 30 is mounted into the developing device 20, a development gear group 20G of the developing device 20 described later is connected to the transmission gear 310 to input a torque to the transmission gear 310.

The right guide 311 (FIG. 3A) is in the form of a projection formed on the right surface of the body portion 31A. The projecting right guide 311 extends in the mounting direction (second direction or the arrow DA direction shown in FIG. 9A) in which the toner container 30 is mounted into the developing device 20. The right guide 311 is engageable with a right guide groove 201R of the developing device 20 described later. It should be noted that a bearing similar to the paddle bearing 302 disposed in the left guide 301 is also disposed inside the right guide 311, the bearing axially supporting the paddle shaft 30K1 of the container paddle 30K passing through the transmission gear 310.

The lock pushing portion 312 is disposed on the right surface of the body portion 31A at an interval from the right guide 311, and is in the form of a projection extending from the body portion 31A. The lock pushing portion 312 has a substantially trapezoid shape in sectional view perpendicularly intersecting the right/left direction (see FIG. 14B). The lock pushing portion 312 is engageable with a locking contact piece 202S described later.

The central guide piece 31P is in the form of a cuboid projection extending from a substantially lateral center of the bottom surface of the body portion 31A of the toner container 30. The central guide piece 31P engages with a central support portion 209 (FIG. 4A) described later when the toner container 30 is mounted into the developing device 20.

The end contact portion 31Q (FIG. 3B) is the projection disposed at the right end of the body portion 31A among a plurality of projections each extending across the boundary between the body portion 31A and the lid portion 31B. Each of the plurality of projections includes an unillustrated internal stud or hole, and is used to adjust the position of the lid portion 31B with respect to the body portion 31A. The end contact portion 31Q further has a function to restrict the sliding movement of the container shutter 32 described later. In other words, the end contact portion 31Q has a function to prevent the container shutter 32 from slipping off the container body 31.

The container shutter 32 (FIG. 2A) is supported on the container body 31 slidably with respect to the toner discharge port 30P, and covers or exposes the toner discharge port 30P. At this time, the container shutter 32 slides along the guide ribs 307 (FIG. 3A) of the container body 31. The container shutter 32 includes a shutter body 32A and the shutter stopper 32B. The shutter stopper 32B is attached to the top of the shutter body 32A.

With reference to FIGS. 5A and 5B, the shutter body 32A is in the form of a substantially rectangular member having a curved surface corresponding to the circumference of the container body 31. The shutter body 32A includes a shutter plate portion 32A1, a pair of release piece support portions 32A2, a pair of stopper axial support portions 32A3, a pair of elastic piece support portions 32A4, a pair of shutter holes 32A6, a shutter contact portion 32A7, a pair of shutter engaging pieces 32A8, a container shutter sheet 320, a pair of guided surfaces 321, and a pair of guided pieces 322.

The shutter plate portion 32A1 constitutes the body of the shutter body 32A and is in the form of a substantially rectangular plate. The release piece support portions 32A2 are in the form of a pair of projections extending from a longitudinally central portion (in the right/left direction shown in FIG. 2A) of the shutter plate portion 32A1, as shown in FIG. 5A. A stopper release piece 32B2 of the shutter stopper 32B described later lies between the pair of release piece support portions 32A2. The stopper axial support portions 32A3 are in the form of a pair of bearings, and are disposed outside the pair of release piece support portions 32A2 in the longitudinal direction. The stopper axial support portions 32A3 respectively rotatably and axially support a pair of stopper support portions 32B3 described later. The elastic piece support portions 32A4 are in the form of a pair of grooves disposed outside the pair of stopper axial support portions 32A3 in the longitudinal direction. Each of the elastic piece support portions 32A4 is defined by a bottom plate flush with the shutter plate portion 32A1, and a pair of side walls. The elastic pieces 32B5 described later are respectively placed in the elastic piece support portions 32A4.

With reference to FIG. 5B, the pair of shutter holes 32A6 each have a long narrow shape and pass through the shutter plate portion 32A1. The shutter holes 32A6 are formed at a front end of the shutter plate portion 32A1 in the second rotational direction (in the direction of the arrow DN shown in FIG. 5B). The shutter contact portion 32A7 is in the form of a slender projection extending between the pair of shutter holes 32A6, and has longitudinally opposite ends extending downstream in the first rotational direction (in the direction of the arrow DM shown in FIG. 5B). The shutter contact portion 32A7 has a function to restrict the movement of the container shutter 32 in the second rotational direction. The shutter engaging pieces 32A8 are in the form of a pair of projections and are each disposed between the shutter plate portion 32A1 and one of the pair of elastic piece support portions 32A4 in the longitudinal direction. The shutter engaging pieces 32A8 have a substantially triangular shape. The shutter engaging pieces 32A8 are respectively engageable with a pair of container shutter fastening portions 207 of the developing device 20 described later.

The container shutter sheet 320 is adhered to the surface of the shutter body 32A of the container shutter 32 that covers the toner discharge port 30P. In the present embodiment, the container shutter sheet 320 is made of a resin film. As shown in FIG. 5B, a downstream front end (container shutter sheet front end 320S) of the container shutter sheet 320 in the first rotational direction (in the arrow DM direction) slightly projects beyond the shutter plate portion 32A1 of the container shutter 32 and has a free end. Further, an upstream end of the container shutter sheet 320 in the first rotational direction is in contact with the shutter contact portion 32A7.

With reference to FIG. 5B, the guided surfaces 321 are each disposed between the shutter plate portion 32A1 and one of the pair of elastic piece support portions 32A4 and at a different level from the shutter plate portion 32A1 and the elastic piece support portions 32A4. Each of the guided pieces 322 consists of a pair of projections extending from the bottom surface of an elastic piece support portion 32A4 to upstream and downstream sides of a guided surface 321 in the first rotational direction, respectively. A space is defined between each of the guided surfaces 321 and each of the guided pieces 322, the space extending in the first rotational direction. Respective one ends of the guide ribs 307 of the toner container 30 are inserted into the spaces through guide insertion openings 32T shown in FIG. 5B to thereby attach the container shutter 32 to the container body 31. As a result, the container shutter 32 is slidable on the container body 31.

The shutter stopper 32B is attached to the surface of the shutter body 32A opposite to the surface that covers the toner discharge port 30P. The shutter stopper 32B has a function to restrict the sliding movement of the container shutter 32. With reference to FIGS. 6A and 6B, the shutter stopper 32B includes a stopper plate 32B1, the stopper release piece 32B2, the pair of stopper support portions 32B3, the pair of stopper locking pieces 32B4, and the pair of elastic pieces 32B5. The stopper plate 32B1 constitutes the body of the shutter stopper 32B, and has a substantially rectangular shape. The stopper release piece 32B2 is in the form of a projection extending from a longitudinally central portion (in the right/left direction shown in FIG. 2A) of the stopper plate 32B1. As shown in FIG. 5A, the stopper release piece 32B2 projects from the stopper plate 32B1 downstream in the first rotational direction. As mentioned above, the stopper release piece 32B2 lies between the pair of release piece support portions 32A2 of the shutter body 32A. The stopper support portions 32B3 are in the form of a pair of projections provided near the longitudinally opposite ends of the stopper plate 32B1, each of the projection including a distal end having a shaft slightly projecting therefrom. The shafts of the stopper support portions 32B3 are respectively inserted into the stopper axial support portions 32A3 of the shutter body 32A mentioned above. Consequently, the shutter stopper 32B is pivotable with respect to the shutter body 32A around an axis connecting the pair of stopper support portions 32B3.

The stopper locking pieces 32B4 are in the form of a pair of projections extending from the longitudinally opposite ends of the stopper plate 32B1. As shown in FIGS. 6A and 6B, the stopper locking pieces 32B4 have a substantially triangular shape. The stopper locking pieces 32B4 connect with the stopper support portions 32B3 in the first rotational direction (FIG. 6B). The elastic pieces 32B5 are in the form of a pair of slender projections provided on longitudinally both sides of the shutter stopper 32B. Each of the elastic pieces 32B5 extends in the first rotational direction and has a free distal end.

When the pair of stopper support portions 32B3 are inserted into the pair of stopper axial support portions 32A3 so that the shutter body 32A and the shutter stopper 32B constitute an integral structure, the pair of stopper locking pieces 32B4 enter the shutter holes 32A6 (FIG. 5B). Further, the pair of elastic pieces 32B5 are placed into the elastic piece support portions 32A4. At this time, respective distal ends of the elastic pieces 32B5 are exposed on the backside of the container shutter 32, as shown in FIG. 5B.

The container screw 33 (FIG. 2B) is disposed in the container body 31 and extends in the right/left direction. One end of the container screw 33 is supported on the above-mentioned screw bearing 304. The container screw 33 conveys the toner in the container body 31 from the left side to the right side and discharges the toner through the toner discharge port 30P.

The container paddle 30K (see FIG. 11B) is pivotably disposed in the container body 31. The container paddle 30K has a function to stir the toner in the container body 31. The container paddle 30K includes the paddle shaft 30K1 and a blade portion 30K2. The paddle shaft 30K1 defines the pivotal axis of the container paddle 30K. The paddle shaft 30K1 is disposed in the container body 31 and extends in the right/left direction, the paddle shaft 30K1 being axially supported on the above-mentioned paddle bearing 302 (FIG. 2B). Further, the paddle shaft 30K1 is connected to the transmission gear 310 (FIG. 3B) at the right end of the toner container 30. The blade portion 30K2 is in the form of a plate extending from the paddle shaft 30K1, and pivots on the paddle shaft 30K1 in the container body 31.

The container seal 34 (FIGS. 2B and 3B) is made of an elastic material and disposed on the discharge projection 308 in such a manner as to surround the toner discharge port 30P. In the present embodiment, the container seal 34 is made of urethane sponge (elastic material). The container seal 34 is resiliently compressed by the container shutter sheet 320 (FIG. 5B) of the container shutter 32 to thereby prevent leakage of toner through the toner discharge port 30P in the closed state of the container shutter 32.

The developing device 20 receives toner supplied from the toner container 30. The developing device 20 includes a container mounting section 20H (mounting section), the development housing 200 (housing), a developing roller 21A, a first screw 21B, and a second screw 21B.

The development housing 200 contains toner. The container mounting section 20H is defined by the top surface of the development housing 200 (FIG. 4B). The toner container 30 is mounted in the container mounting section 20H. The developing roller 21A (FIG. 1) is rotatably supported on the development housing 200. The developing roller 21A carries toner on its circumferential surface. Further, the developing roller 21A supplies the toner to the photoconductive drum 121. The first screw 21B and the second screw 21B are rotatably supported on the development housing 200. The first screw 21B and the second screw 21B are rotationally driven to circularly convey the toner in the development housing 200. As a result, the toner is charged to have a predetermined polarity. Further, the first screw 21B supplies toner to the developing roller 21A.

The development housing 200 includes a housing right wall 200R, a housing left wall 200L, a housing ceiling plate 200U, the left guide groove 201L (guide mechanism), the right guide groove 201R (guide mechanism), a lock button 202, a main unit shutter guide portion 203, the toner supply port 204 (developer supply port), a main unit seal 205 (main unit seal), a stopper pushing portion 206, the pair of container shutter fastening portions 207 (fastening portion), a pair of shutter springs 208 (biasing member), the central support portion 209, and the development gear group 20G The housing right wall 200R is a side wall standing at the right end of the development housing 200. Similarly, the housing left wall 200L is a side wall standing at the left end of the development housing 200. The above-mentioned container mounting section 20H is defined between the housing right wall 200R and the housing left wall 200L. The housing ceiling plate 200U is a ceiling plate of the development housing 200 and extends between the housing right wall 200R and the housing left wall 200L. The housing ceiling plate 200U includes a front end having a curved surface corresponding to the circumference of the toner container 30.

The left guide groove 201L and the right guide groove 201R are respectively formed in the housing left wall 200L and the housing right wall 200R. The left guide groove 201L and the right guide groove 201R guide the mounting of the toner container 30 into the container mounting section 20H. Therefore, respective inlet portions of the left guide groove 201L and the right guide groove 201R are so formed as to extend in the mounting direction (second direction or the arrow DA direction shown in FIG. 9A). On the other hand, respective furthest end portions of the left guide groove 201L and the right guide groove 201R are in the form of a sector to permit rotation of the left guide 301 and the right guide 311 as described later.

The lock button 202 is in the form of a pushing button and slidably supported on the housing right wall 200R. The lock button 202 has functions to lock the orientation of the toner container 30 mounted in the container mounting section 20H and release the locking. The operation of the lock button 202 will be described in detail later.

The main unit shutter guide portion 203 is defined by a portion of the housing ceiling plate 200U that is slightly raised. The main unit shutter guide portion 203 extends in the forward/backward direction and has a predetermined width in the right/left direction. The main unit shutter guide portion 203 includes a left guide rail 203L and a right guide rail 203R. The left guide rail 203L and the right guide rail 203R are formed at the left and right ends of the main unit shutter guide portion 203, respectively. The left guide rail 203L and the right guide rail 203R have a function to guide sliding movement of the main unit shutter 22 described later.

The toner supply port 204 is formed in the main unit shutter guide portion 203 in a substantially rectangular shape. The toner supply port 204 communicates with the inside of the development housing 200. Further, the toner supply port 204 faces the toner container 30 mounted in the container mounting section 20H. Toner having been discharged through the toner discharge port 30P of the toner container 30 flows into the development housing 200 through the toner supply port 204.

The main unit seal 205 (FIG. 4B) is an elastic seal disposed on the main unit shutter guide portion 203 in such a manner as to surround the toner supply port 204. In the present embodiment, the main unit seal 205 is made of urethane sponge (elastic material). The main unit seal 205 is resiliently compressed by the main shutter 22 (FIG. 4A) described later to thereby prevent leakage of toner (developer) through the toner supply port 204 in the closed state of the main unit shutter 22.

The stopper pushing portion 206 is in the form of a projection extending from the housing ceiling plate 200U of the development housing 200 and disposed behind and adjacent to the toner supply port 204. The stopper pushing portion 206 has a function to push the stopper release piece 32B2 of the container shutter 32 of the toner container 30 when the toner container 30 is mounted into the container mounting section 20H. In other words, the stopper pushing portion 206 allows the sliding movement of the container shutter 32.

The container shutter fastening portions 207 are in the form of a pair of projections extending from the housing ceiling plate 200U and sandwich the stopper pushing portion 206 in the right/left direction. The container shutter fastening portions 207 have a substantially trapezoid shape in sectional view perpendicularly intersecting the right/left direction. Each of the container shutter fastening portions 207 has a wedge-shaped cutout formed in a front side portion thereof. The shutter engaging pieces 32A8 (FIG. 5A) of the container shutter 32 of the toner container 30 respectively engage with the cutouts when the toner container 30 is mounted into the container mounting section 20H. As a result, the container shutter fastening portions 207 secure the container shutter 32 to thereby restrain the container shutter 32 from moving.

The pair of shutter springs 208 are disposed outside the pair of container shutter fastening portions 207 in the right/left direction. The shutter springs 208 extend in the forward/backward direction. Respective one ends of the shutter springs 208 are respectively engaged with main body spring locking portions 200T (FIG. 4A) provided in the housing ceiling plate 200U. Further, the respective other ends of the shutter springs 208 are respectively engaged with shutter spring locking portions 222 (FIG. 4A) of the main body shutter 22 described later.

The central support portion 209 is in the form of a projection extending upward from a substantially central portion of the housing ceiling plate 200U in the right/left direction. The central support portion 209 has a curved upper edge corresponding to the circumference of the toner container 30. Further, the central support portion 209 has an internal cavity into which the central guide piece 31P (FIG. 3A) of the toner container 30 can be inserted. In the rotation of the toner container 30 in the container mounting section 20H, the central guide piece 31P moves in the forward/backward direction in the central support portion 209, as described later. Further, the central support portion 209 has a function to support the laterally central portion of the toner container 30.

The development gear group 20G includes a plurality of gears disposed at the inner side of the housing right wall 200R and rotatably supported on the development housing 200. The development gear group 20G transmits a torque to the developing roller 21A (FIG. 1), the first screw 21B, the second screw 21B, and the container screw 33 (FIG. 2B) and the container paddle 30K (FIG. 11B) of the toner container 30.

Further, the developing device 20 includes the main unit shutter 22 (main unit shutter). The main unit shutter 22 is supported on the development housing 200 slidably with respect to the toner supply port 204. The main unit shutter 22 covers or exposes the toner supply port 204. With reference to FIGS. 7A and 7B, the main unit shutter 22 includes a main unit shutter plate 220, a pair of side pieces 221, the pair of shutter spring locking portions 222, a pair of main unit shutter pushing portions 223, a pair of shutter ribs 224, and a main unit sheet 22F.

The main unit shutter plate 220 constitutes the body of the main unit shutter 22, and is in the form of a rectangular plate having a predetermined curved surface. The main unit shutter plate 220 has a main unit covering surface 220S shown in FIG. 7A which covers the toner supply port 204. The side pieces 221 are in the form of a pair of substantially triangular plates which respectively join the laterally opposite ends of the main unit shutter plate 220. The shutter spring locking portions 222 are in the form of a pair of openings respectively formed in outer ends of the pair of side pieces 221. As mentioned above, the other ends of the shutter springs 208 are engaged with the shutter spring locking portions 222. The main unit shutter pushing portions 223 are defined by respective surfaces of the pair of side pieces 221 that serve as pushing surfaces. The main unit shutter pushing portions 223 are engageable with the container shutter pushing pieces 305S of the toner container 30. The main unit shutter pushing portions 223 have functions to push the container shutter pushing pieces 305S and to be pushed by the container shutter pushing pieces 305S. Each of the pair of shutter ribs 224 stands on the opposite end of a side piece 221 from a main unit shutter pushing portion 223. The shutter ribs 224 maintain the rigidity of the side pieces 221.

The main unit sheet 22F is adhered to the surface of the main unit shutter 22 opposite to the main unit covering surface 220S, the surface facing the toner container 30 mounted in the container mounting section 20H. In the present embodiment, the main unit sheet 22F is made of a film seal. As shown in FIGS. 7A and 7B, the main unit sheet 22F has a main unit sheet distal end 22F1 (the upstream end in the first rotational direction (in the direction of the arrow DM) or the downstream end in the second rotational direction (in the direction of the arrow DN)) slightly projecting beyond the main unit shutter plate 220 and having a free end. Further, the main unit sheet 22F has a proximal end opposite to the main unit sheet distal end 22F1, the proximal end being placed in a substantially central portion of the main unit shutter plate 220.

The above-mentioned shutter springs 208 bias the main unit shutter 22 in the direction to cover the toner supply port 204 (FIG. 4B). As shown in FIG. 4A, when the toner container 30 is dismounted from the developing device 20, the main unit shutter 22 covers the toner supply port 204 owing to a biasing force of the shutter springs 208. At this time, the main unit shutter pushing portions 223 of the main unit shutter 22 are in contact with a pair of main unit shutter restricting portions 203S (see FIGS. 4B and 12), whereby the position of the main unit shutter 22 is regulated (see FIG. 15D). In addition, a pair of main unit shutter guide portions 22G of the main unit shutter 22 shown in FIG. 7A are respectively engaged with the curved left guide rail 203L and right guide rail 203R (FIG. 4A). This allows the shutter springs 208 to bias the main unit shutter 22 in the second rotational direction (in the arrow DN direction shown in FIG. 7A). The main unit shutter 22 slides around the axis of the paddle shaft 30K1 (FIG. 11B) of the toner container 30, the axis extending in the right/left direction.

When the toner container 30 is mounted in the container mounting section 20H, the main unit shutter pushing portions 223 (FIG. 7B) of the main unit shutter 22 face the container shutter pushing portions 305 (FIG. 8) of the toner container 30. This allows the shutter springs 208 to bias, via the main unit shutter 22, the toner container 30 mounted in the container mounting section 20H around the above-mentioned axis in the second rotational direction (see FIGS. 15B and 15C).

Figure 9A:
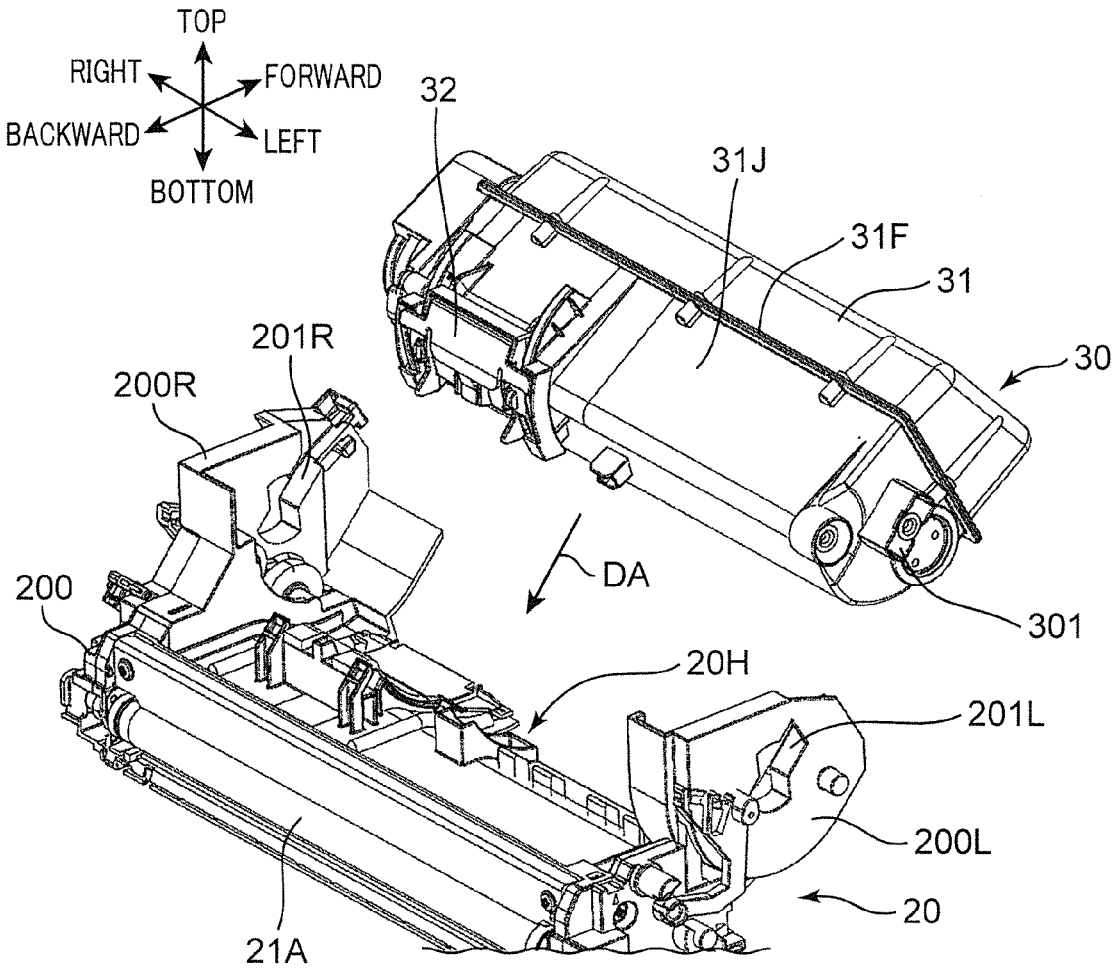
FIG. 9A is a perspective view illustrating mounting of the developer container into the main unit in the embodiment of the present disclosure.
Figure 9B:
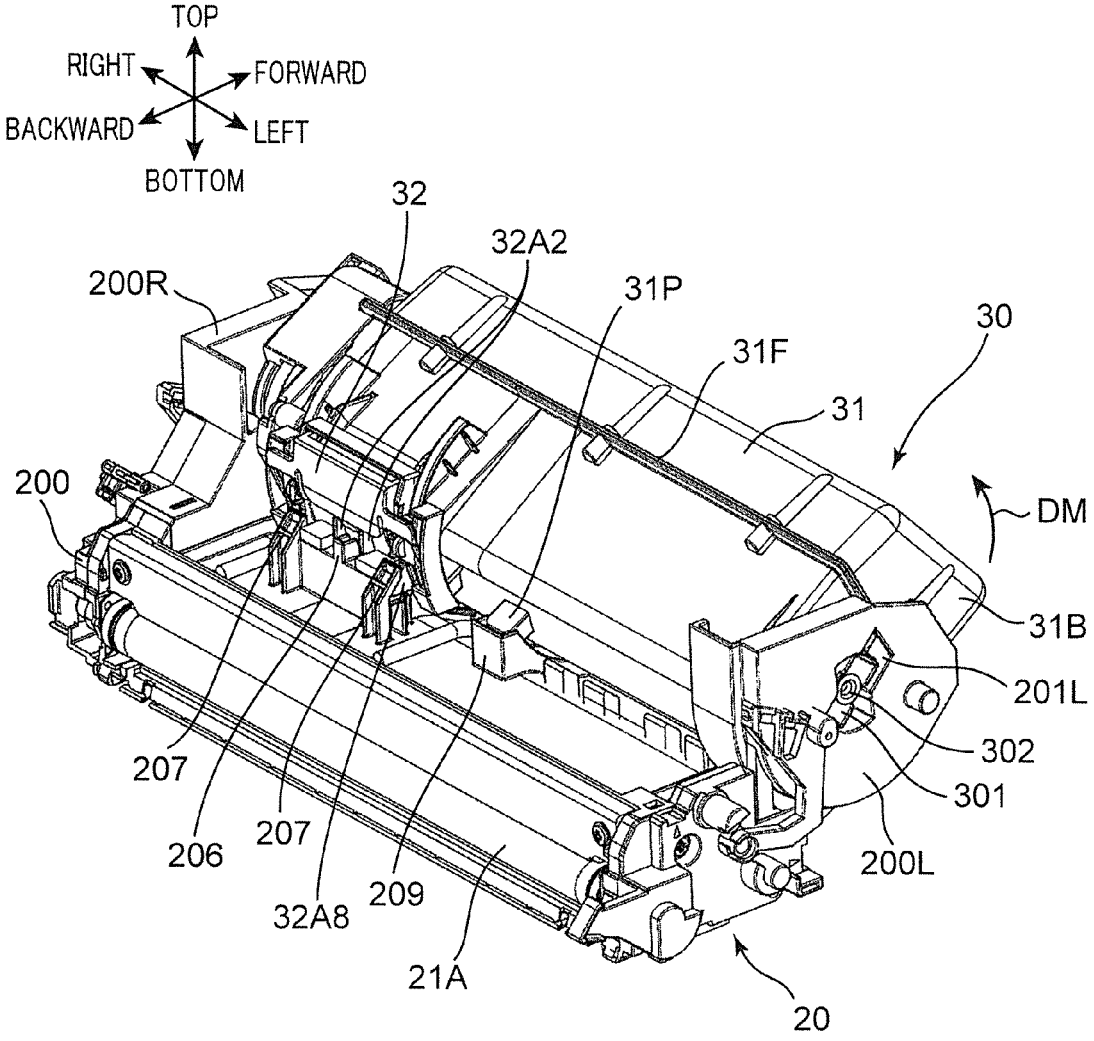
FIG. 9B is a perspective view illustrating the mounting of the developer container into the main unit in the embodiment of the present disclosure.
Figure 9C:
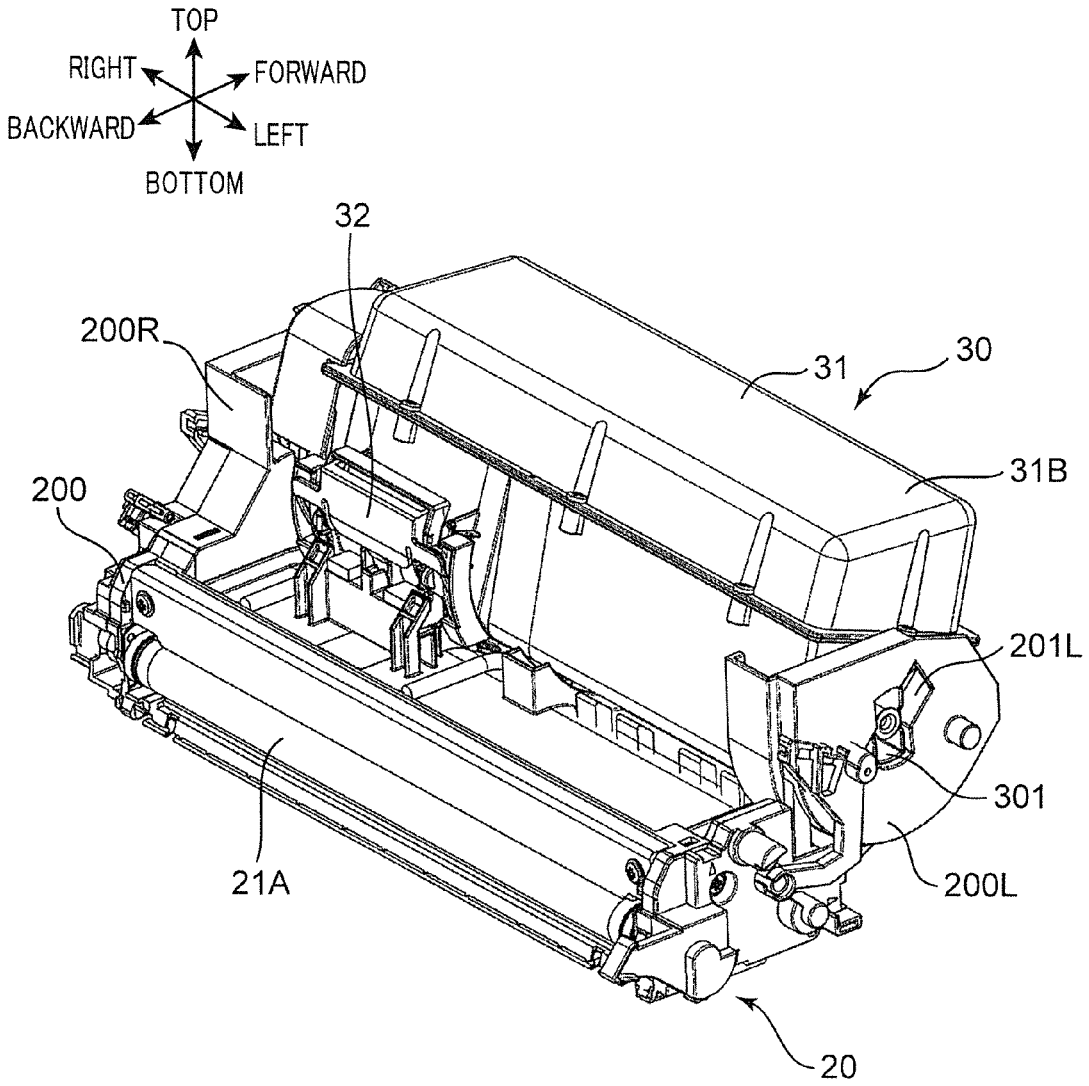
FIG. 9C is a perspective view showing a state that the developer container is mounted on the main unit in the embodiment of the present disclosure.
Figure 10A:
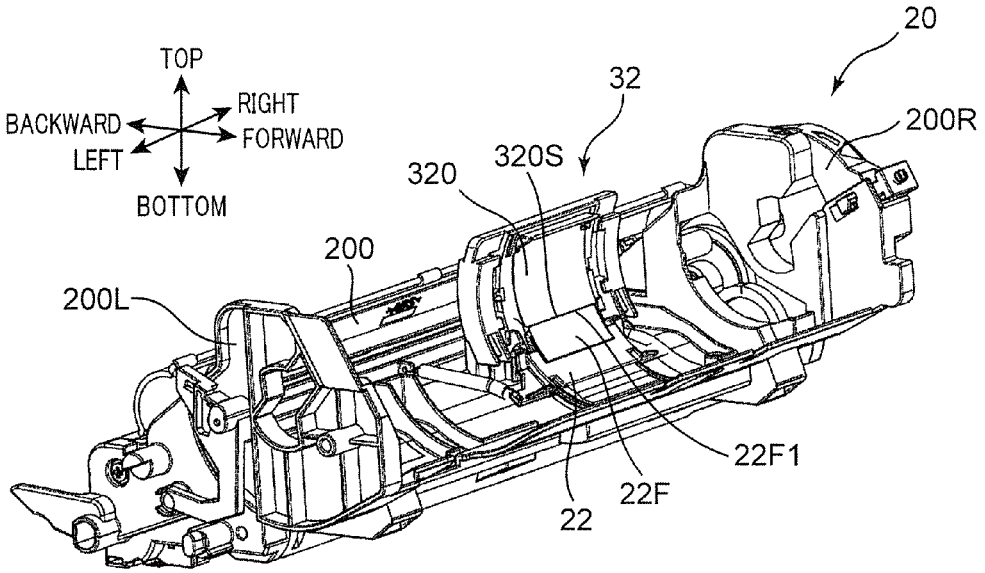
FIG. 10A is a perspective view of the main unit and the container shutter according to the embodiment of the present disclosure.
Figure 10B:
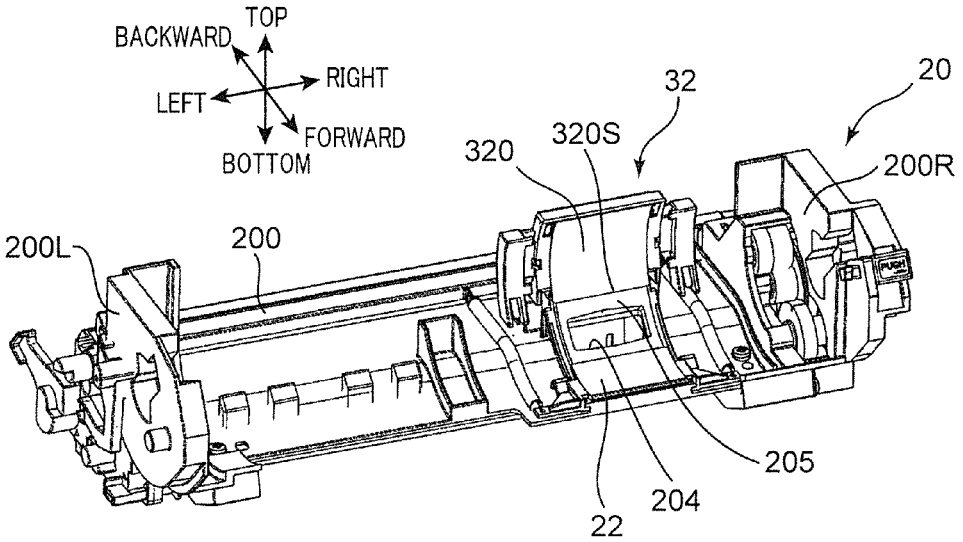
FIG. 10B is a perspective view of the main unit and the container shutter according to the embodiment of the present disclosure.
Figure 11C:
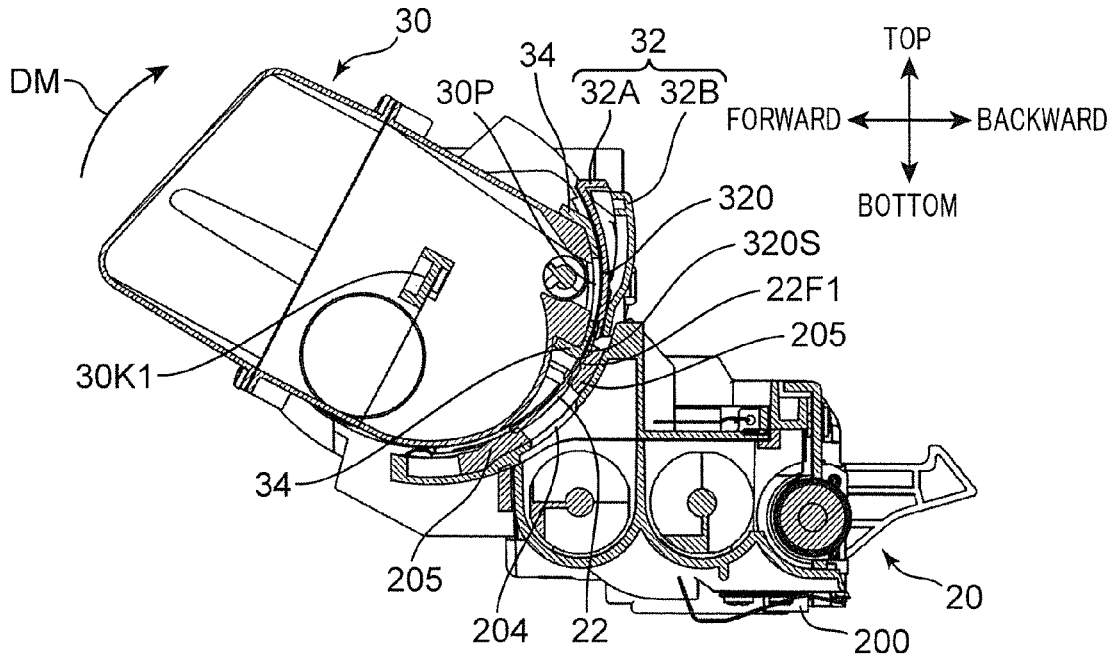
FIG. 11C is a sectional view illustrating the mounting of the developer container into the main unit in the embodiment of the present disclosure.
Figure 11D:
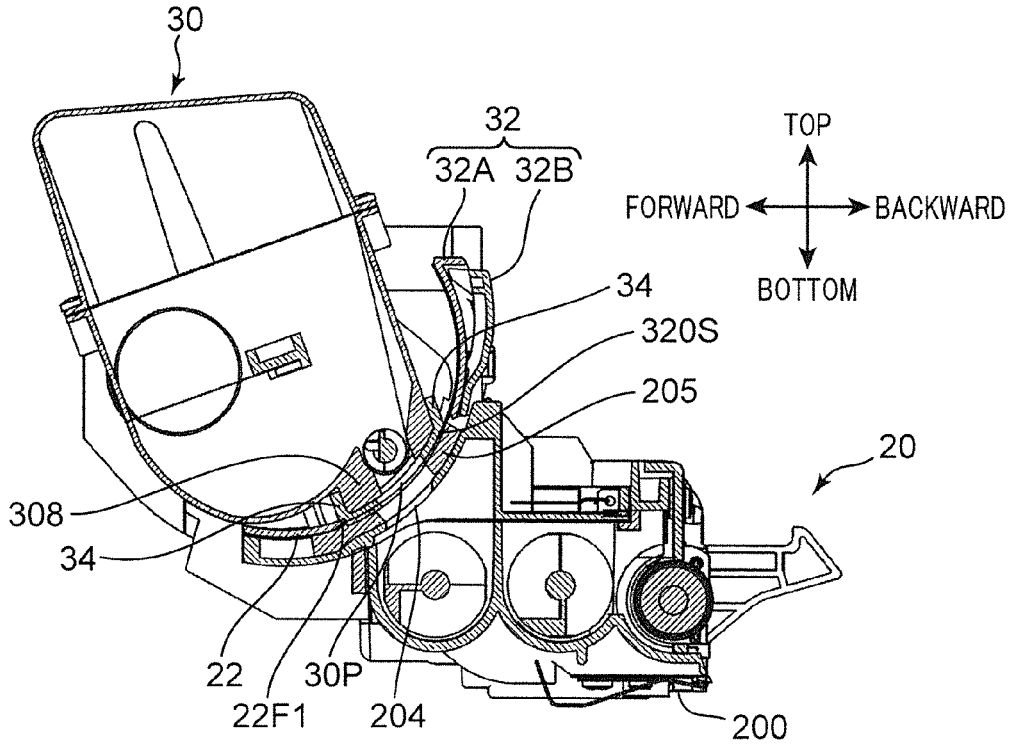
FIG. 11D is a sectional view showing a state that the developer container is mounted on the main unit in the embodiment of the present disclosure.

Now, the mounting of the toner container 30 into the developing device 20 will be described with reference to FIGS. 9A to 11D. FIGS. 9A to 9C are perspective views illustrating the mounting of the toner container 30 into the developing device 20 in the present embodiment. FIGS. 9A and 9B illustrate the course of mounting of the toner container 30, and FIG. 9C shows the state that the toner container 30 is mounted on the developing device 20. Further, FIGS. 10A and 10B are perspective views of the developing device 20 with the container shutter 32 of the toner container 30 mounted thereon. FIG. 10A shows the state that the toner supply port 204 is covered by the main unit shutter 22, and FIG. 10B shows the state that the toner supply port 204 is exposed from the main unit shutter 22. Further, FIG. 11A is an enlarged plan view of the developing device 20 and the toner container 30. FIGS. 11B to 11D are sectional views illustrating the mounting of the toner container 30 into the developing device 20. FIGS. 11B and 11C illustrate the course of mounting of the toner container 30, and FIG. 11D shows the state that the toner container 30 is mounted on the developing device 20, FIGS. 11B to 11D being the sectional views taken along the dashed line V1-V1 in FIG. 11A.

If the container shutter 32 is accidentally moved from the position at which the container shutter 32 has covered the toner discharge port 30P in the course of mounting of the toner container 30 into the developing device 20, toner would leak through the toner discharge port 30P. In the present embodiment, the container shutter 32 is prevented from sliding away from the toner discharge port 30P when the toner container 30 is independent. Specifically, as shown in FIGS. 2A and 3A, when the container shutter 32 covers the toner discharge port 30P, the stopper locking pieces 32B4 (FIG. 5B) passing through the shutter holes 32A6 are engaged with the container shutter engaging portions 309S of the container shutter locking ribs 309 of the container body 31. Further, the distal ends of the elastic pieces 32B5 (FIG. 5B), which are exposed from the elastic piece support portions 32A4 on the backside of the container shutter 32, are biased radially outward of the toner container 30 by the elastic piece pushing portions 306 (FIG. 8). Because the distal ends of the elastic pieces 32B5 are thus biased, a moment acts on the shutter stopper 32B (FIG. 6A) in the direction that brings the stopper locking pieces 32B4 into strong engagement with the container shutter engaging portions 309S (FIG. 8), with the pair of stopper support portions 32B3 acting as a fulcrum. Therefore, the container shutter 32 is prevented from sliding along the guide ribs 307 when the toner container 30 is stored or transported independently. As a result, the toner discharge port 30P is reliably covered by the container shutter 32*b* (FIG. 5B).

With reference to FIGS. 9A and 11B, a user of the printer 100 mounts the toner container 30 into the developing device 20. At this time, the user can easily hold the toner container 30 by placing the index-fingers and the middle fingers on an upper portion of the container flanges 31F and the thumbs on a lower portion of the container flanges 31F of the toner container 30 shown in FIG. 11B. The user inserts the left guide 301 and the right guide 311 into the left guide groove 201L and the right guide groove 201R to thereby mount the toner container 30 into a first position (FIGS. 9B and 11C) of the container mounting section 20H while being guided in the second direction (in the arrow DA direction shown in FIGS. 9A and 11B) by the left guide groove 201L and the right guide groove 201R. The orientation of the toner container 30 shown in FIGS. 9B and 11C is defined as a first orientation.

At this time, as shown in FIG. 9B, the stopper pushing portion 206 of the development housing 200 pushes the stopper release piece 32B2 (FIGS. 5A and 6A) disposed between the pair of release piece support portions 32A2. Consequently, the shutter stopper 32B pivots on the pair of stopper support portions 32B3, so that the pair of stopper locking pieces 32B4 disengage from the container shutter engaging portions 309S (FIG. 8). As a result, the container shutter 32 is released from the shutter stopper 32B to become slidable.

On the other hand, when the toner container 30 is mounted in the container mounting section 20H in the first orientation, the pair of shutter engaging pieces 32A8 (FIGS. 5A and 9B) of the container shutter 32 engage with the wedge-shaped cutouts of the container shutter fastening portions 207. As a result, the container shutter 32 is secured to the container shutter fastening portions 207. Thereafter, the user rotates the container body 31 of the toner container 30 from the first position in the first rotational direction (in the arrow DM direction shown in FIGS. 9B and 11C) around an axis extending in the first direction (right/left direction). At this time, the container body 31 moves to a second position with the toner discharge port 30P moving away from the container shutter 32. At the second position, the exposed toner discharge port 30P communicates with the toner supply port 204 of the developing device 20 (FIGS. 9C and 11D). In other words, the toner discharge port 30P moves with the container body 31 in the first rotational direction. Thus, the toner discharge port 30P slides out of the secured container shutter 32 to be exposed and to lie above and communicate with the toner supply port 204 (FIG. 11D). The orientation of the toner container 30 shown in FIGS. 9C and 11D is defined as a second orientation.

In the rotation of the toner container 30 from the first orientation in the first rotational direction, the elastic piece pushing portions 306 of the container body 31 having pushed the distal ends (FIG. 5B) of the elastic pieces 32B5 of the shutter stopper 32B move away from the elastic pieces 32B5. Therefore, when the toner discharge port 30P is exposed, the elastic pieces 32B5 are prevented from continuously receiving a strong force and thus prevented from plastic deformation.

Further, when the toner container 30 is not mounted in the container mounting section 20H, the main unit shutter 22 covers the toner supply port 24. As shown in FIGS. 9B and 11C, when the toner container 30 is mounted in the container mounting section 20H in the first orientation, the container shutter pushing pieces 305S (FIG. 8) of the toner container 30 face the main unit shutter pushing portions 223 of the main unit shutter 22 (see FIG. 15C). Thereafter, the toner container 30 is rotated in the first rotational direction to change from the first orientation to the second orientation as mentioned above to thereby allow the container shutter pushing pieces 305S to push the main unit shutter pushing portions 223 in the first rotational direction against the biasing force of the shutter springs 208 (FIG. 4A). Consequently, the main unit shutter 22 slides in the first rotational direction with the rotation of the container body 31 of the toner container 30, so that the toner supply port 204 is exposed as shown in FIG. 4B. This allows the toner discharge port 30P and the toner supply port 204 to vertically communicate with each other (FIG. 11D).

With reference to FIGS. 9B and 10A, when the toner container 30 is mounted into the container mounting section 20H in the first orientation, the container shutter sheet front end 320S (FIG. 5B) of the container shutter sheet 320 of the toner container 30 comes to rest opposite to the main unit sheet distal end 22F1 (FIGS. 7A and 7B) of the main unit sheet 22F of the main unit shutter 22 at a small distance therefrom. At this time, the container shutter sheet front end 320S comes into contact with a portion of the main unit seal 205 that lies above the toner supply port 204 (FIG. 11C). Therefore, when the toner container 30 is rotated in the first rotational direction to change from the state shown in FIG. 11C to the state shown in FIG. 11D, the discharge projection 308 (FIG. 11D) of the toner container 30 slides smoothly from the container shutter sheet 320 to the main unit seal 205. This allows smooth rotation of the toner container 30. Further, because the container shutter sheet front end 320S covers the upper portion of the main unit seal 205, toner is prevented from leaking backward through the space between the container shutter 32 and the portion of the main unit seal 205 that lies above the toner supply port 204.

Further, when the toner container 30 is mounted into the container mounting section 20H in the first orientation, the main unit sheet distal end 22F1 comes into contact with a portion of the container seal 34 that lies below the toner discharge port 30P (FIG. 11C). Thereafter, the toner container 30 and the main unit shutter 22 are moved in the first rotational direction so that the toner discharge port 30P communicates with the toner supply port 204, with the main unit sheet distal end 22F1 being in contact with the container seal 34. Therefore, in the rotation of the toner container 30, toner is unlikely to leak out through the toner discharge port 30P to stain the top surface of the main unit shutter 22. In particular, in the present embodiment, the rotation of the toner container 30 is immediately transmitted to the main unit shutter 22 via the container shutter pushing portions 305 and the main unit shutter pushing portions 223. Therefore, the container body 31 and the main unit shutter 22 are allowed to integrally rotate in the first rotational direction in the change of orientation of the toner container 30 from the first orientation to the second orientation. This allows the main unit sheet distal end 22F1 to substantially come into contact with the container seal 34 at a fixed position. Consequently, a shift of the main unit sheet distal end 22F1 is prevented and, in turn, leakage of toner is further prevented.

Figure 12:
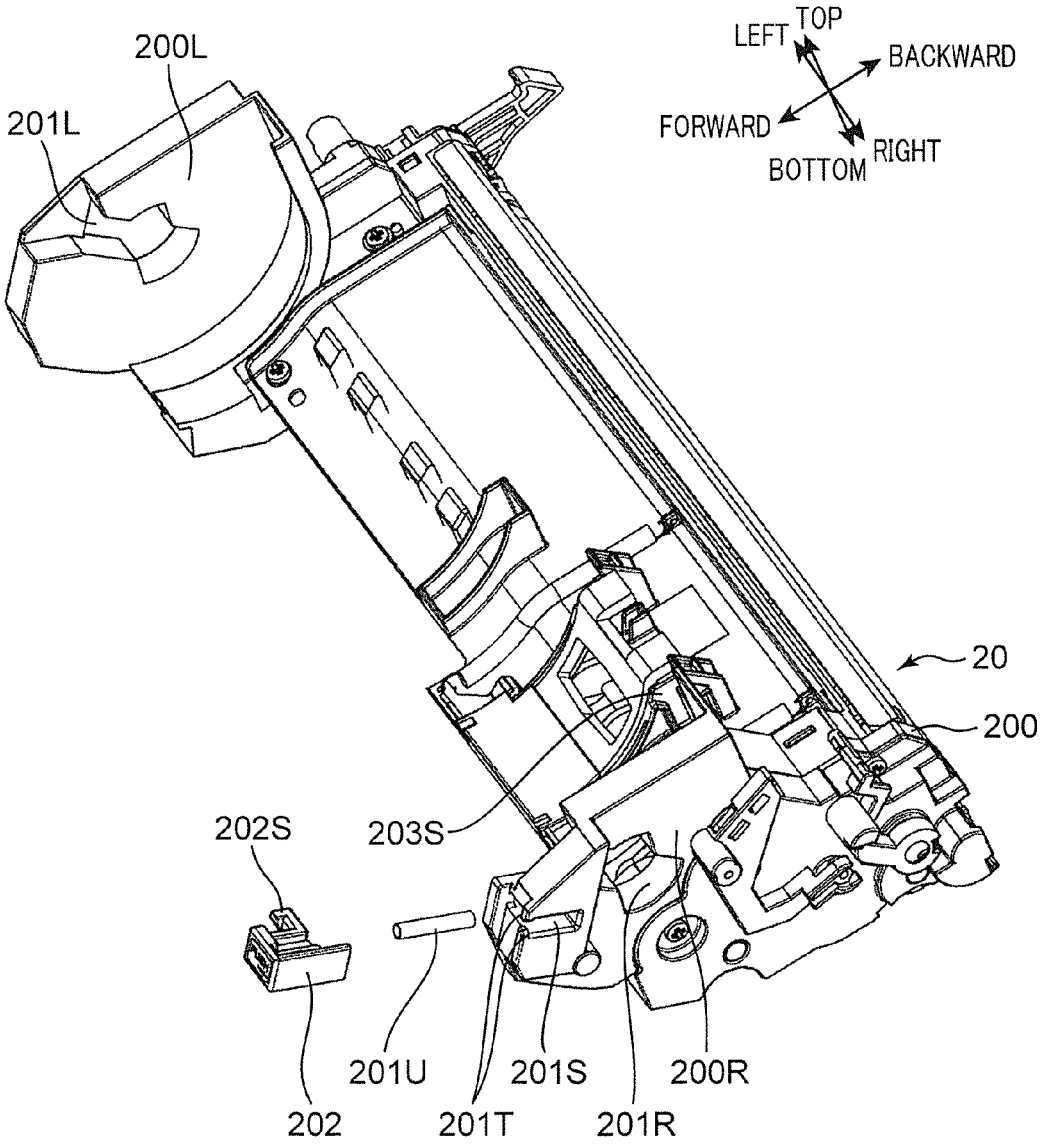
FIG. 12 is an exploded perspective view of the main unit according to the embodiment of the present disclosure.
Figure 13A:
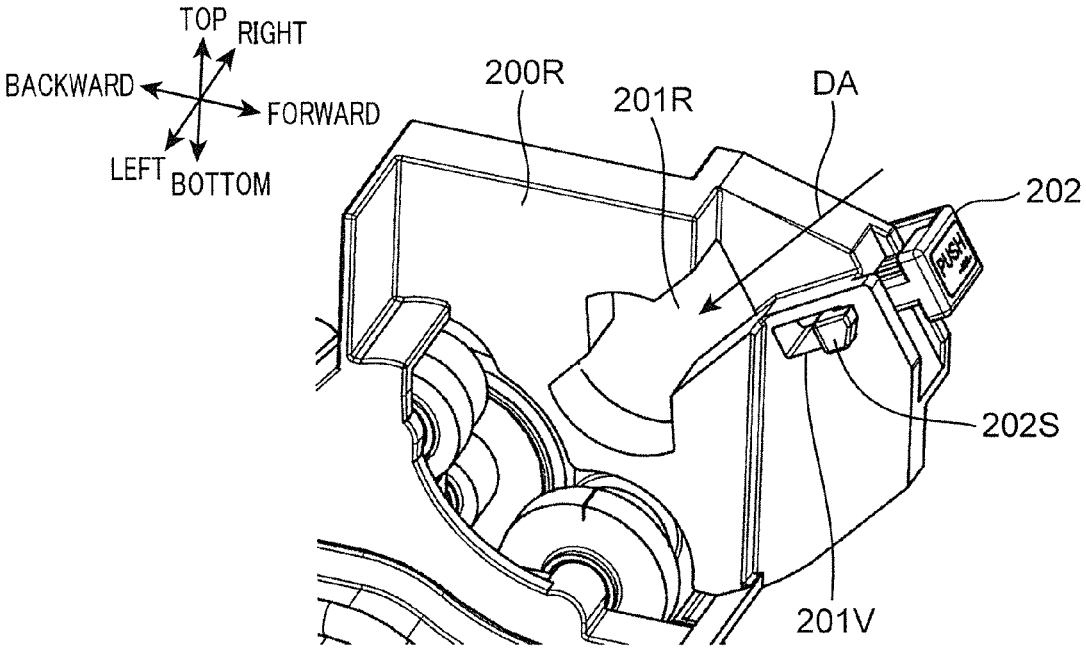
FIG. 13A is an enlarged perspective view of a part of the main unit according to the embodiment of the present disclosure.
Figure 13B:
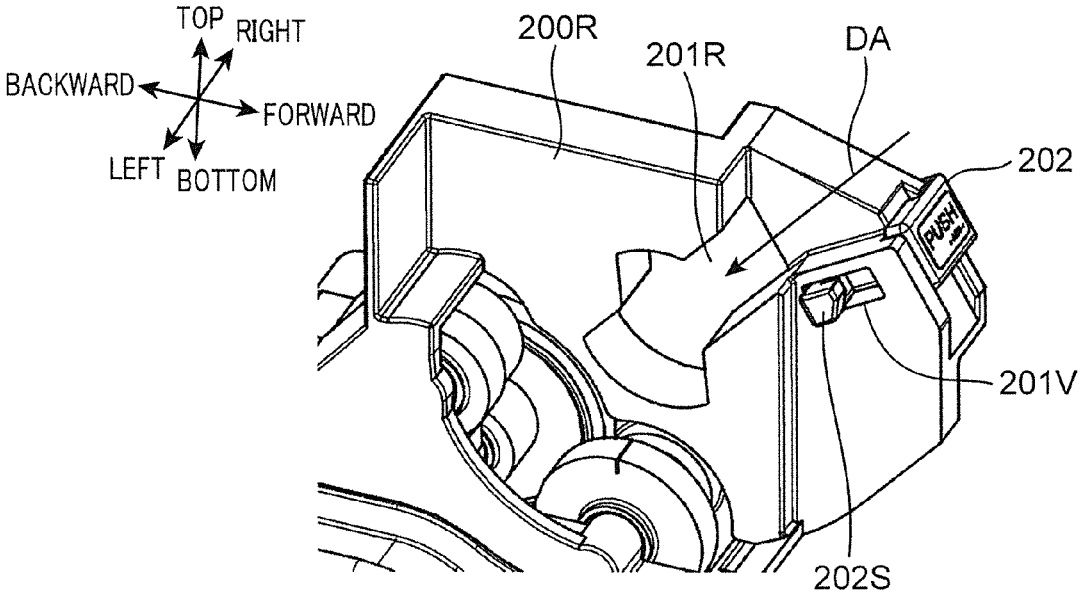
FIG. 13B is an enlarged perspective view of the part of the main unit according to the embodiment of the present disclosure.
Figure 14A:
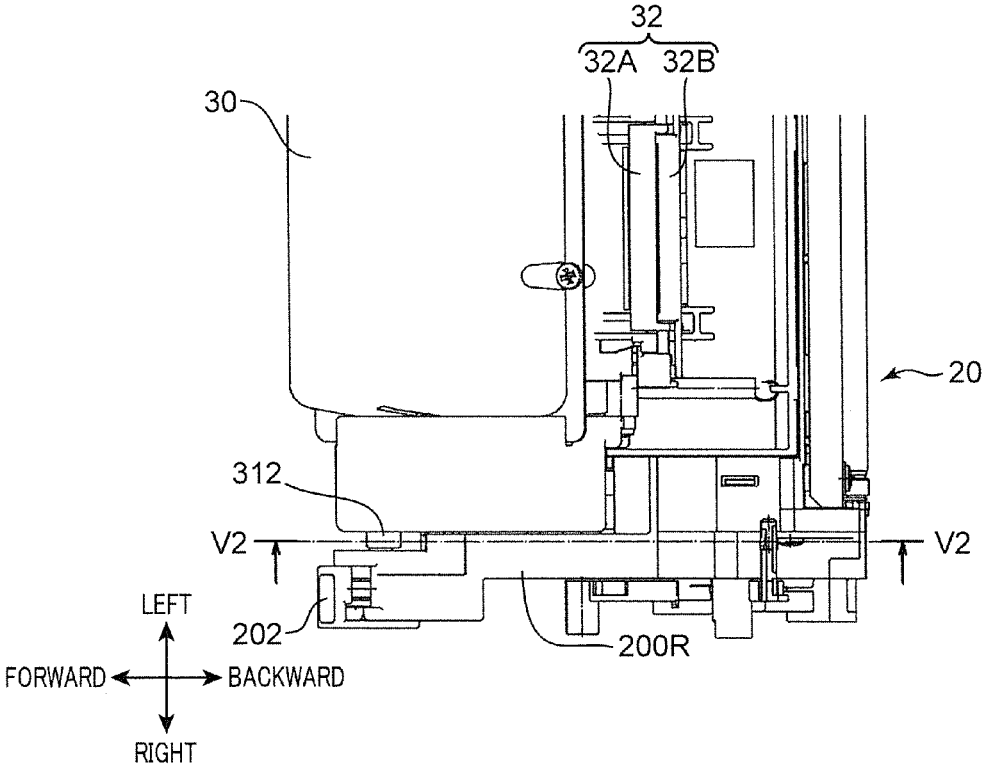
FIG. 14A is an enlarged plan view of the main unit and the developer container according to the embodiment of the present disclosure.

Further, locking and release of the toner container 30 in the developing device 20 will be described with reference to FIGS. 12 to 15D. FIG. 12 is an exploded perspective view of the developing device 20 according to the present embodiment, with the lock button 202 and a lock biasing spring 201U separated from the development housing 200. FIGS. 13A and 13B are enlarged perspective views of a part (a portion around the housing right wall 200R of the development housing 200) of the developing device 20. FIG. 14A is an enlarged plan view of the developing device 20 and the toner container 30. FIGS. 14B to 14E are sectional views illustrating dismounting of the toner container 30 from the developing device 20, FIGS. 14B to 14E being the sectional views taken along the dashed line V2-V2 in FIG. 14A. Similarly, FIG. 15A is an enlarged plan view of the developing device 20 and the toner container 30. FIGS. 15B to 15D are sectional views illustrating the dismounting of the toner container 30 from the developing device 20, FIGS. 15B to 15D being the sectional views taken along the dashed lined V3-V3 in FIG. 15A.

With reference to FIG. 12, the housing right wall 200R of the development housing 200 includes a lock guide groove 201S and a pair of lock engaging pieces 201T. The lock guide groove 201S is formed in a portion of the housing right wall 200R that is in front of the right guide groove 201R. The lock engaging pieces 201T are in the form of a pair of projections formed at a front side portion of the housing right wall 200R and extending into the lock guide groove 201S. Further, the developing device 20 includes the lock biasing spring 201U. The lock biasing spring 201U is configured by a coil spring disposed in the lock guide groove 201S for biasing the lock button 202 forward. Further, the above-mentioned lock button 202 includes the locking contact piece 202S. The locking contact piece 202S is in the form of a projection extending leftward in the lock button 202. The locking contact piece 202S has a function to lock the toner container 30 in the second orientation. Further, the lock button 202 including the locking contact piece 202S has a function to release the locking of the toner container 30.

Further, with reference to FIG. 13A, a guide opening 201V is formed in a left portion of the housing right wall 200R. The guide opening 201V is a long hole extending in a direction slightly intersecting the mounting direction (in the direction of the arrow DA shown in FIG. 13A) of the toner container 30. The lock button 202 is inserted into the lock guide groove 201S while resiliently compressing the lock biasing spring 201U, with the locking contact piece 202S going into the guide opening 201V. At this time, the lock button 202 stops with a front end thereof slightly projecting frontward out of the housing right wall 200R owing to a biasing force of the lock biasing spring 201U. The lock button 202 is prevented from disengagement owing to the lock engaging pieces 201T. The user pushes the lock button 202 against the biasing force of the lock biasing spring 201U so that the locking contact piece 202S moves from the front end to the rear end of the guide opening 201V, as shown in FIG. 13B.

Figure 14B:
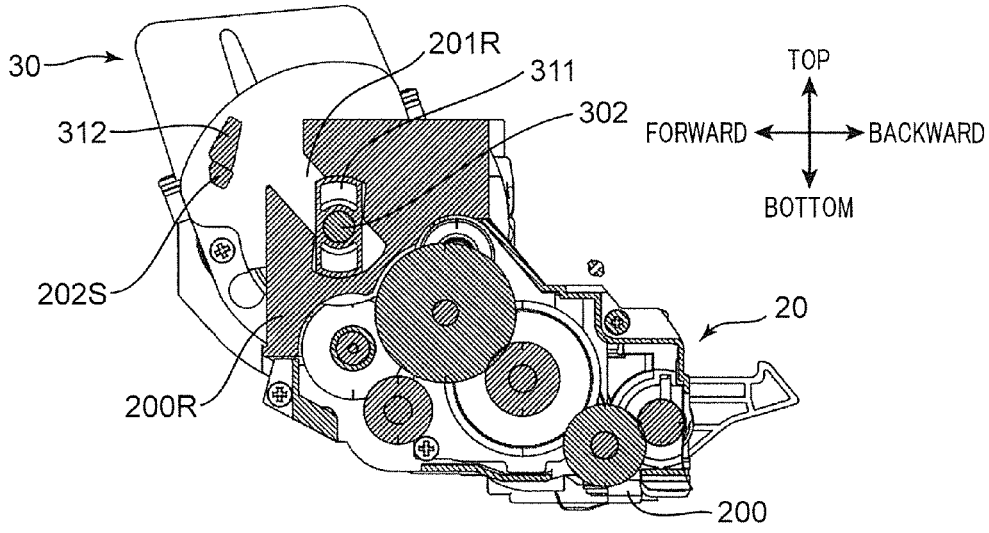
FIG. 14B is a sectional view illustrating dismounting of the developer container from the main unit in the embodiment of the present disclosure.
Figure 14C:
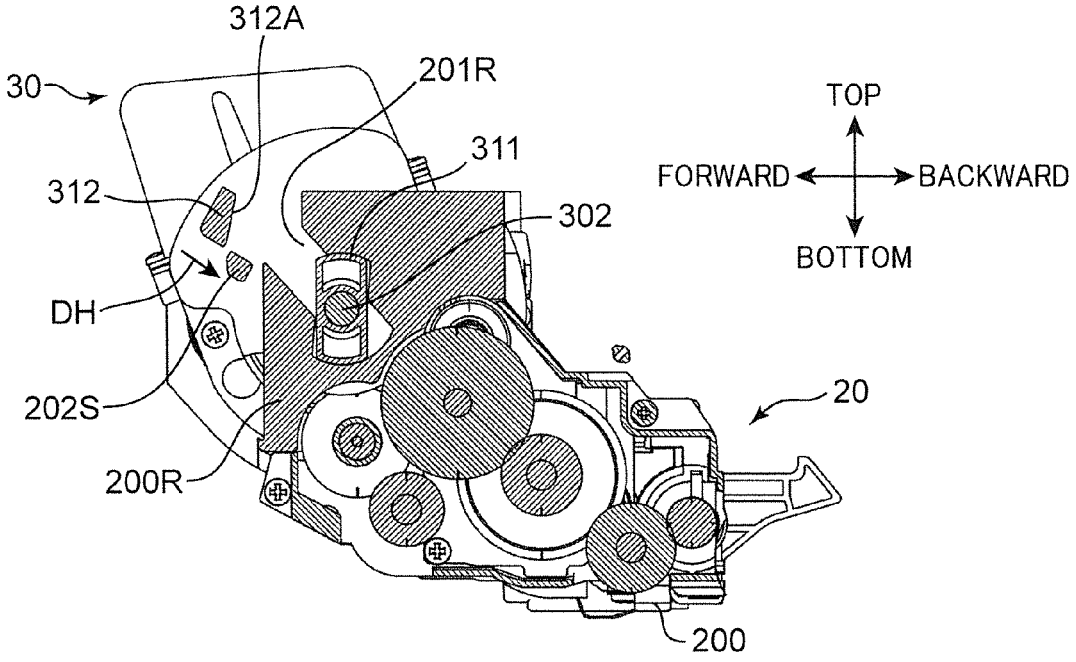
FIG. 14C is a sectional view illustrating the dismounting of the developer container from the main unit in the embodiment of the present disclosure.
Figure 14D:
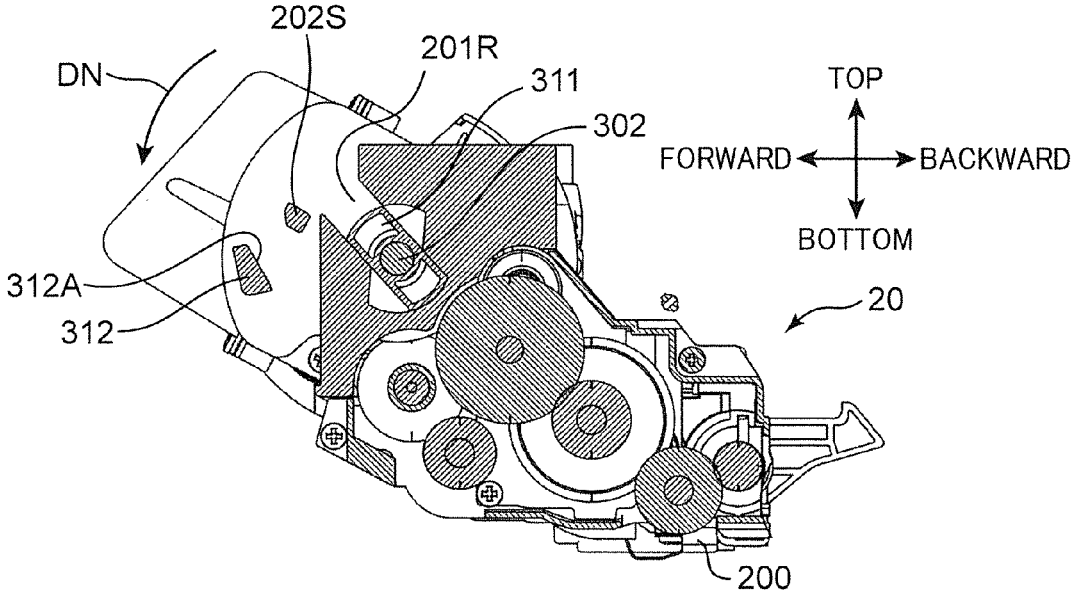
FIG. 14D is a sectional view illustrating the dismounting of the developer container from the main unit in the embodiment of the present disclosure.
Figure 14E:
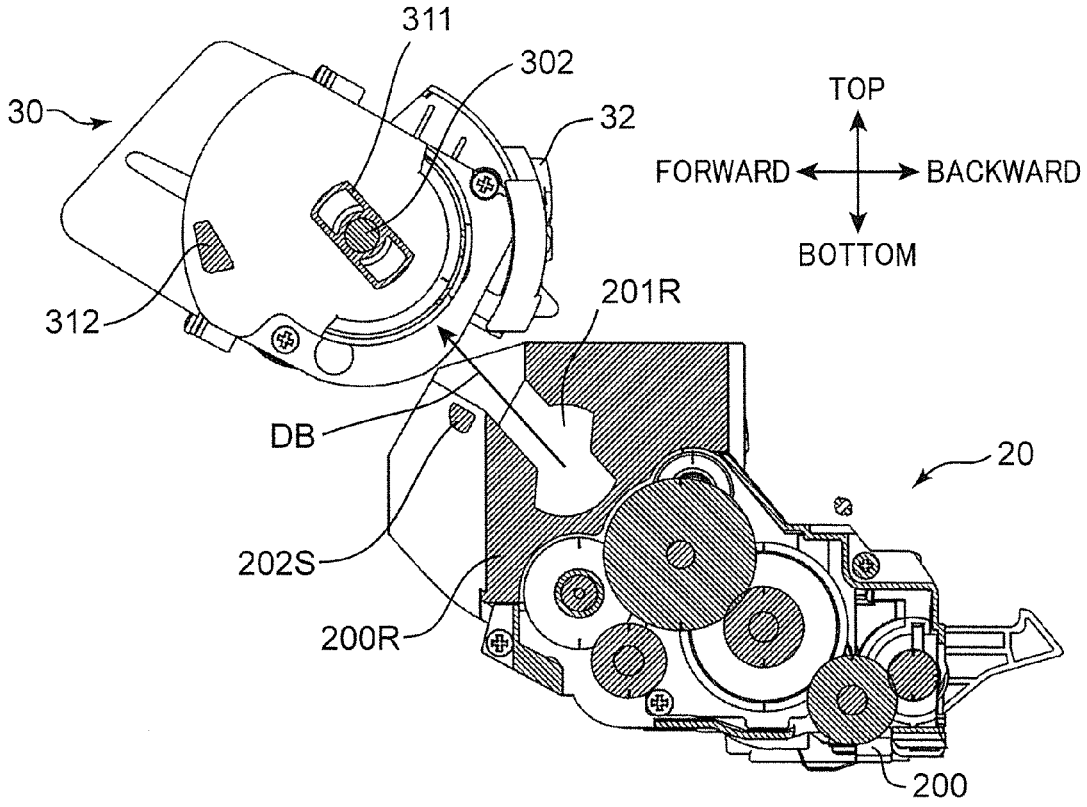
FIG. 14E is a sectional view illustrating the dismounting of the developer container from the main unit in the embodiment of the present disclosure.
Figure 15A:
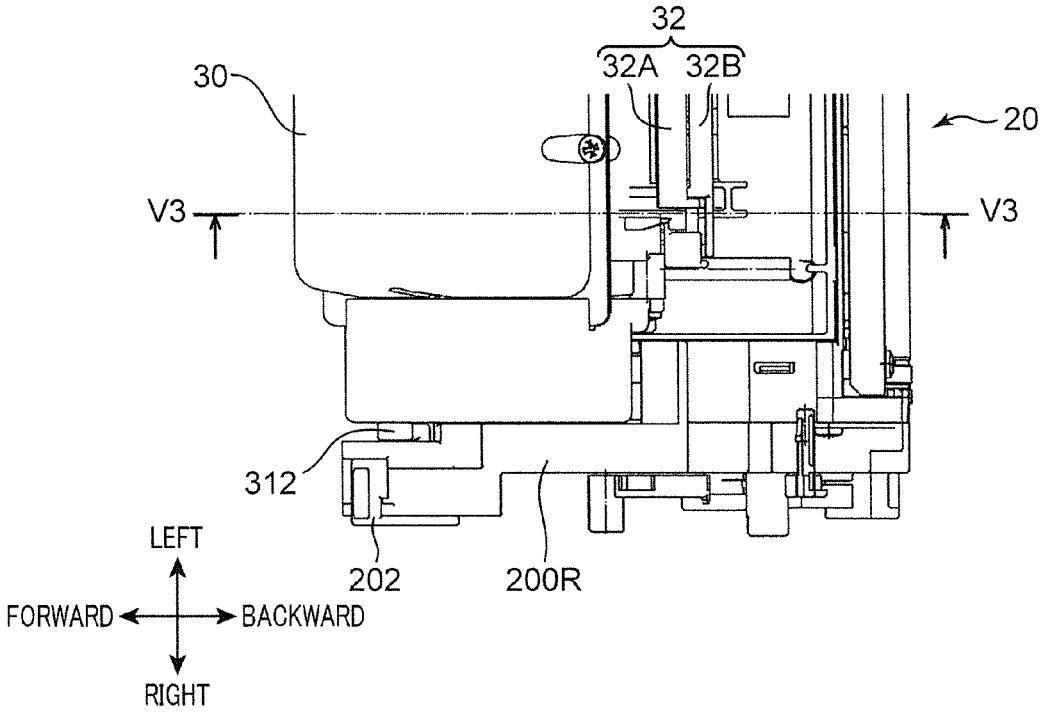
FIG. 15A is an enlarged plan view of the main unit and the developer container according to the embodiment of the present disclosure.
Figure 15B:
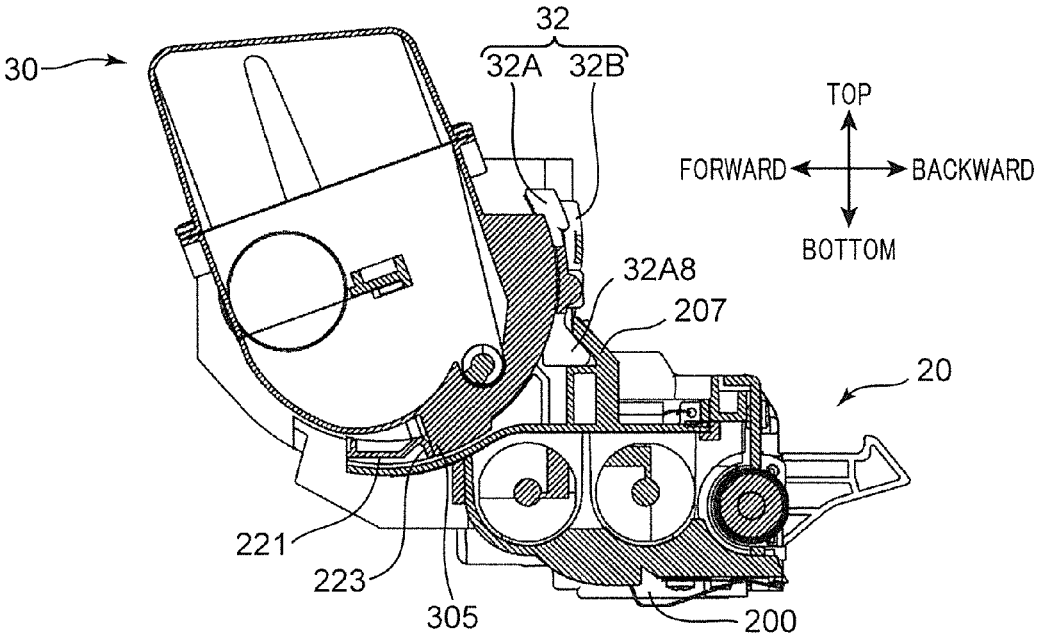
FIG. 15B is a sectional view illustrating dismounting of the developer container from the main unit in the embodiment of the present disclosure.
Figure 15C:
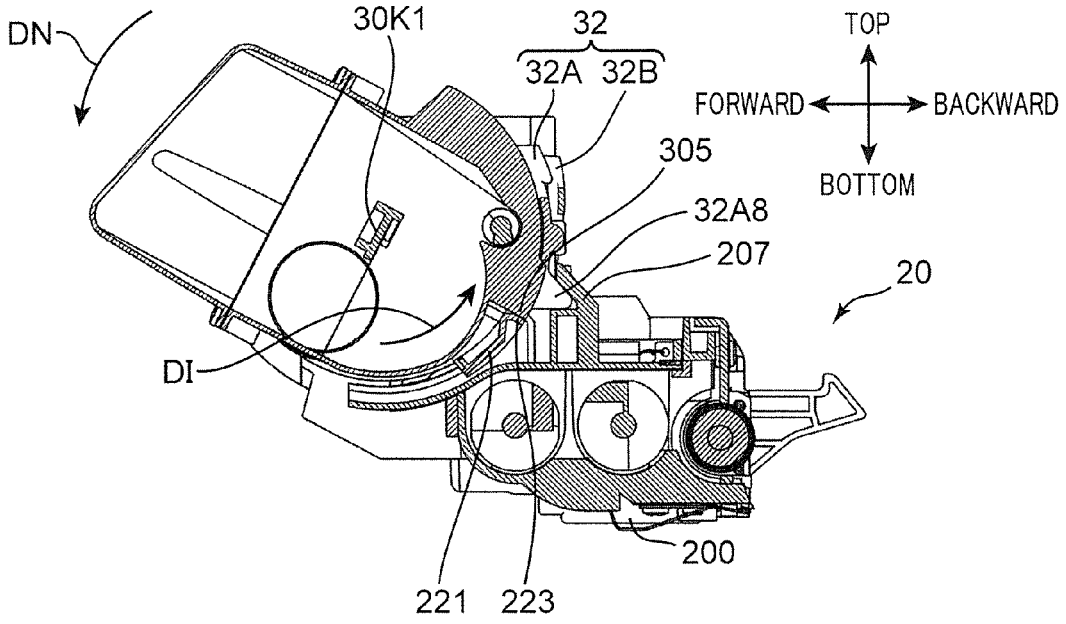
FIG. 15C is a sectional view illustrating the dismounting of the developer container from the main unit in the embodiment of the present disclosure.
Figure 15D:
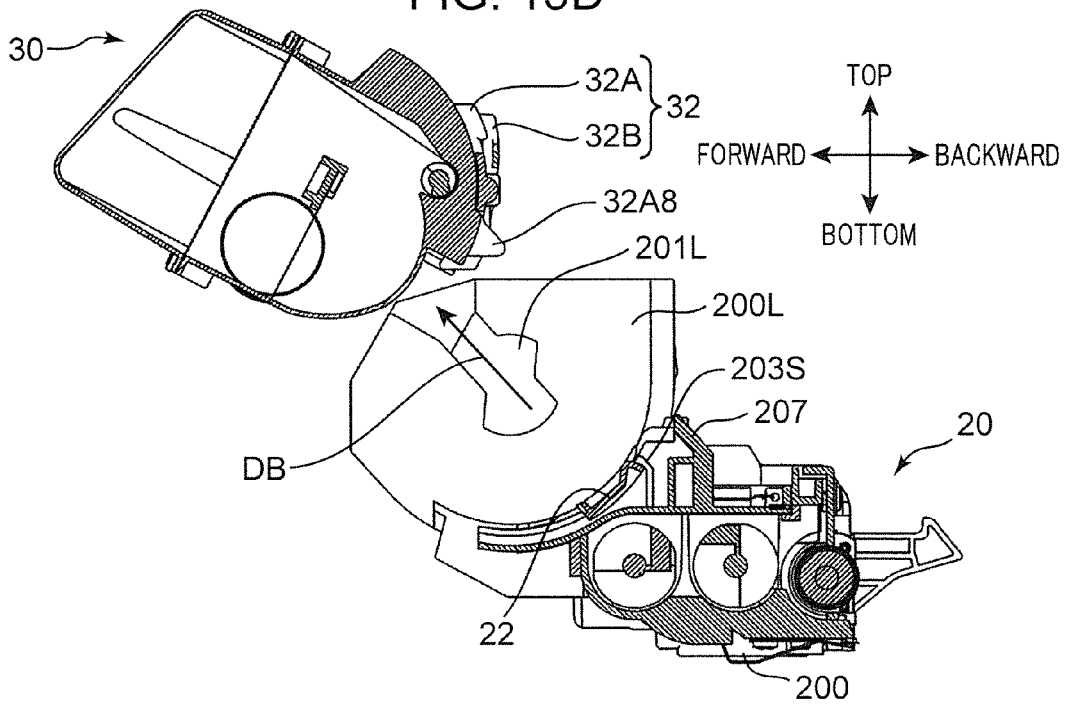
FIG. 15D is a sectional view illustrating the dismounting of the developer container from the main unit in the embodiment of the present disclosure.

As shown in FIGS. 9B and 11C, when the user rotates the toner container 30 in the first rotational direction (FIGS. 9C and 11D) after mounting the toner container 30 in the container mounting section 20H in the first orientation, the lock pushing portion 312 (FIGS. 3A and 3B) of the toner container 30 engages with the locking contact piece 202S (FIG. 13A) (FIG. 14B). As a result, the locking contact piece 202S locks the toner container 30 in the second orientation. In this locked state, the locking contact piece 202S lies below the lock pushing portion 312, as shown in FIG. 14B. Therefore, even though the biasing force of the shutter springs 208 (FIG. 4A) acts on the container shutter pushing portions 305 of the toner container 30 via the main unit shutter 22, the toner container 30 is prevented from rotating in the second rotational direction, i.e. changing from the second orientation to the first orientation. Further, at this time, as shown in FIG. 14B, the right guide 311 of the toner container 30 intersects the inlet portion of the right guide groove 201R extending in the second direction. The left guide 301 on the left side of the toner container 30 is similarly disposed. In the above-described manner, the present embodiment makes it possible to bring the toner discharge port 30P into communication with the toner supply port 204 and lock the toner container 30 in the second orientation by allowing a user to mount the toner container 30 into the developing device 20 in the second direction and subsequently rotate the toner container 30 in the first rotational direction. In other words, a user can mount the toner container 30 and expose the toner discharge port 30P by performing the two successive operations. This makes it possible to prevent opening failure of the toner discharge port 30P. Further, it is possible to stably supply toner from the toner container 30 to the developing device 20 in accordance with an image formation operation in the printer 100.

On the other hand, when an unillustrated sensor detects that the toner container 30 is empty of toner, an indication for replacement of the toner container 30 is shown on an unillustrated display of the printer 100. When a user pushes the lock button 202 (FIG. 13A), the locking contact piece 202S moves backward along the guide opening 201V (FIG. 13B). As a result, the locking contact piece 202S moves backward away from the lock pushing portion 312 as shown by the arrow DH in FIG. 14C to disengage from the lock pushing portion 312. Thus, the restraining force having been exerted on the lock pushing portion 312 is lost, and the locking of the toner container 30 is released. Because the main unit shutter 22 receives the biasing force of the shutter springs 208, the main unit shutter pushing portions 223 of the main unit shutter 22 move in the second rotational direction (in the direction of the arrow DI shown in FIG. 15C) while pushing the container shutter pushing portions 305 of the toner container 30 in the second rotational direction. As a result, the toner container 30 rotates from the second position in the second rotational direction (in the direction of the arrow DN shown in FIG. 14C and 15C) around the paddle bearing 302 disposed coaxially with the paddle shaft 30K1 (FIG. 11B). In other words, the toner container 30 automatically changes its orientation from the second orientation to the first orientation owing to the biasing force of the shutter springs 208, thereby returning to the first orientation. In the rotation of the toner container 30 in the second rotational direction, the locking contact piece 202S is biased by an oblique surface 312A of the lock pushing portion 312 owing to the biasing force of the lock biasing spring 201U. When the lock pushing portion 312 moves away from the locking contact piece 202S, the locking contact piece 202S returns to the position shown in FIG. 13A.

In the change of orientation of the toner container 30, the toner discharge port 30P moves in the second rotational direction to be covered again by the container shutter 32 at the first position. In addition, the main unit shutter 22 slides owing to the biasing force of the shutter springs 208, thereby changing its state from the state shown in FIG. 4B to the state shown in FIG. 4A. As a result, the toner supply port 204 is covered again by the main unit shutter 22.

The toner container 30 returned to the first orientation is detached from the first position of the container mounting section 20H in a third direction (in the direction of the arrow DB shown in FIGS. 14E and 15D) opposite to the second direction to be thereby dismounted from the developing device 20. In this manner, in the present embodiment, a user only needs to push the lock button 202 to release the locking of the toner container 30 so that the toner container 30 changes into the first orientation in which the toner container 30 can be easily detached. At this time, the toner discharge port 30P and the toner supply port 204 are covered by the container shutter 32 and the main unit shutter 22, respectively. This makes it possible to prevent the area around the developing device 20 and the toner container 30 from getting stained with toner when the user dismounts the toner container 30 from the developing device 20.

In addition, when the toner container 30 is rotated from the second orientation in the second rotational direction to be dismounted, the elastic piece pushing portions 306 of the container body 31 push the distal ends (FIG. 5B) of the elastic pieces 32B5 of the shutter stopper 32B again, immediately before the stopper locking pieces 32B4 (FIG. 5B) engage with the container shutter engaging portions 309S (FIG. 8) again. As a result, owing to the resilient force of the elastic pieces 32B5, the shutter stopper 32B is biased around the stopper support portions 32B3 in the direction that brings the stopper locking pieces 32B4 into strong engagement with the container shutter engaging portions 309S. Therefore, in the dismounted toner container 30, the container shutter 32 is prevented from accidentally sliding to expose the toner discharge port 30P. Thus, in the present embodiment, the container shutter 32 of the toner container 30 includes itself a stopper mechanism. The shutter stopper 32B including the stopper mechanism permits rotation of the toner container 30 when the toner container 30 is mounted in the container mounting section 20H. Further, when the toner container 30 is stored independently, sliding movement of the container shutter 32 is stably restrained.

Figure 16:
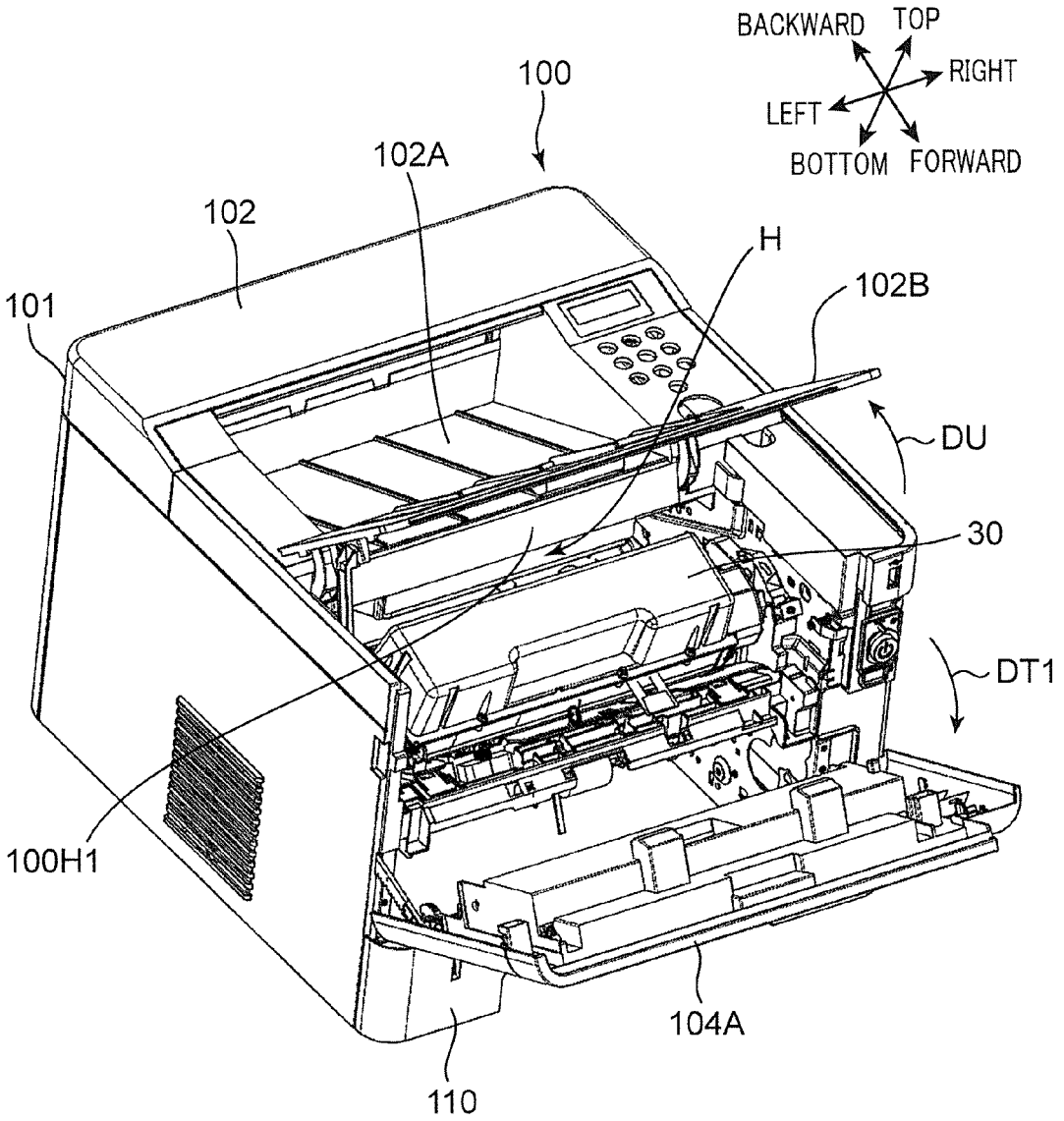
FIG. 16 is a perspective view of the image forming apparatus according to the embodiment of the present disclosure.
Figure 17A:
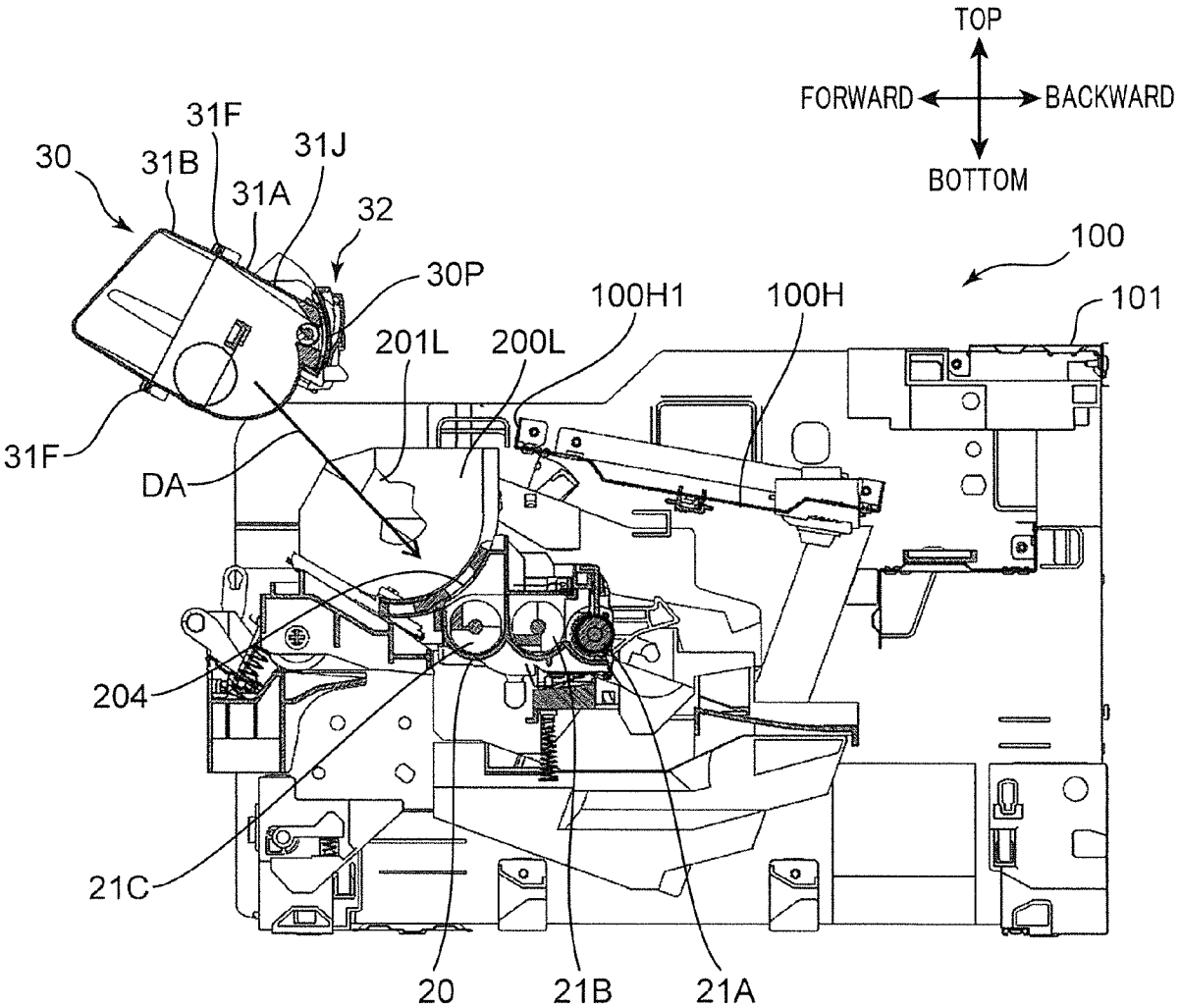
FIG. 17A is a sectional view illustrating the mounting of the developer container into the image forming apparatus in the embodiment of the present disclosure.
Figure 17B:
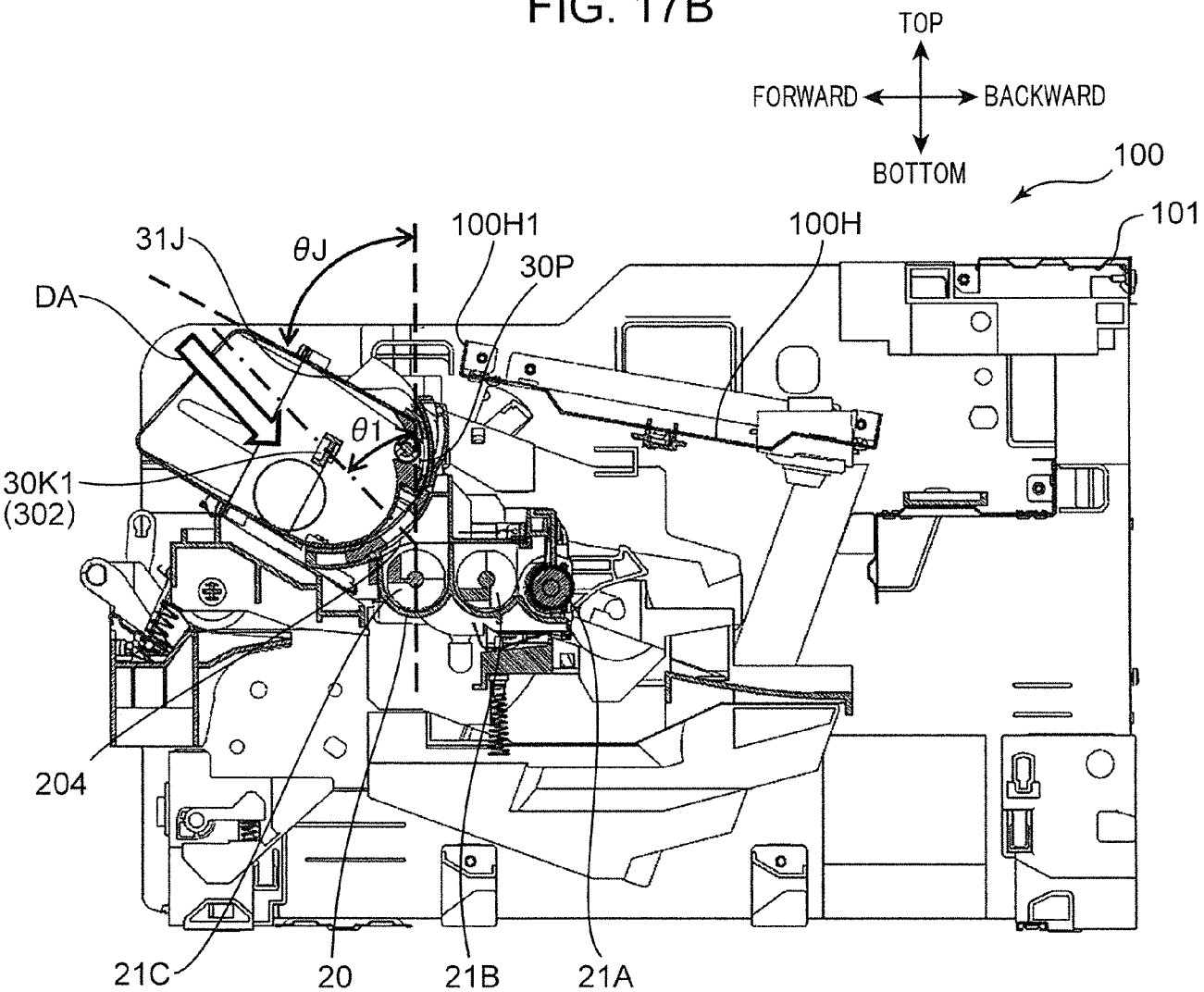
FIG. 17B is a sectional view illustrating the mounting of the developer container into the image forming apparatus in the embodiment of the present disclosure.
Figure 17C:
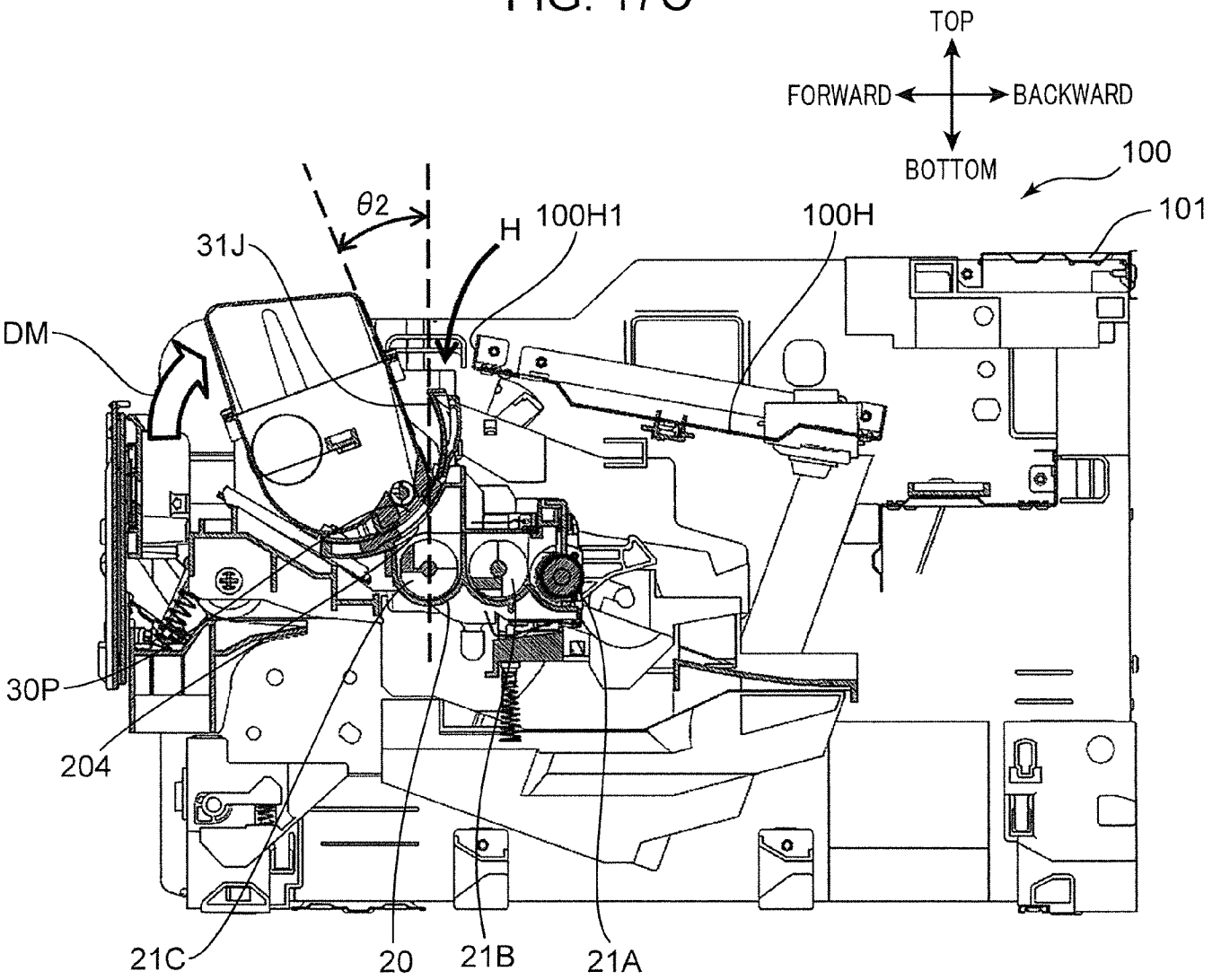
FIG. 17C is a sectional view illustrating the mounting of the developer container into the image forming apparatus in the embodiment of the present disclosure.

Now, the mounting and dismounting of the toner container 30 into and from the developing device 20 will be further described with reference to their relative positions in the printer 100, with reference to FIG. 1 and FIGS. 16 to 17C. FIG. 16 is a perspective view of the printer 100 according to the present embodiment. FIG. 16 shows the printer 100 with a part of the casing 101 being opened. FIGS. 17A to 17C are sectional views illustrating the mounting of the toner container 30 into the developing device 20 in the printer 100.

With reference to FIG. 17A, the toner container 30 is mounted into the printer 100 with a container side wall 31J (side wall) defined by the body portion 31A and the lid portion 31B facing substantially upward. The container side wall 31J constitutes a side wall of the container 30 that is long in the right/left direction (first direction) (see FIG. 9A).

Further, as described above, the manual feed tray 104A is disposed in the main body front wall 104 (FIG. 1) of the casing 101. The manual feed tray 104A is vertically pivotable (as shown by the arrow DT1 in FIG. 16) with a lower end thereof acting as a fulcrum. On the other hand, a front end of the top wall 102 of the casing 101 is openable as a cover 102B. When the cover 102B is opened in addition to the manual feed tray 104A (as shown by the arrow DU in FIG. 16), the toner container 30 is exposed (FIG. 16). Therefore, a user is allowed to mount and dismount the toner container 30 into and from the developing device 20 in the casing 101.

The support frame 100H supporting the exposure device 123 is disposed under the sheet discharge section 102A in the casing 101. The frame front wall 100H1 (wall portion) (FIGS. 16 and 17A) faces, in the forward/backward direction (in the horizontal direction), the container side wall 31J of the toner container 30 that is mounted in the container mounting section 20H of the developing device 20 with the toner discharge port 30P communicating with the toner supply port 204. Further, the developing device 20 is disposed below the support frame 100H. In particular, the housing left wall 200L (the housing right wall 200R) defining the container mounting section 20H of the developing device 20 lies forward of the frame front wall 100H1 (on the upstream side of the frame front wall 100H1 in the mounting direction of the toner container 30) (FIG. 17A). Further, the developing roller 21A is disposed at the rearmost end of the developing device 20 that is opposite to the housing left wall 200L.

In the present embodiment, in order to mount the toner container 30 using as small a space as possible in the casing 101 of the printer 100, the mounting of the toner container 30 is performed by the steps of inserting the toner container 30 in the second direction (in the direction of the arrow DA shown in FIGS. 17A and 17B) and rotating the toner container 30 in the first rotational direction (in the direction of the arrow DM shown in FIG. 17C). In the insertion step, the toner container 30 is guided in the second direction by the right guide groove 201R and the left guide groove 201L (FIG. 4A). In the present embodiment, the second direction (the direction shown by the dashed line in FIG. 17B) refers to a direction extending obliquely downward to a vertical plane at a first angle θ1. For example, the first angle θ1 is set to 45 degrees. When the toner container 30 is mounted in the container mounting section 20H in the first orientation (FIG. 17B), the container side wall 31J is oblique to the vertical plane at an angle θJ. For example, the angle θJ is set to 60 degrees.

The first rotational direction (the arrow DM direction shown in FIG. 17C) in which the toner container 30 is rotated refers to a direction in which the container side wall 31J of the toner container 30 rotates upward around the axis (the paddle shaft 30K1 or the paddle bearing 302) and the toner discharge port 30P rotates downward. When the toner container 30 is mounted in the container mounting section 20H in the second orientation (FIG. 17C), the container side wall 31J is oblique to the vertical plane at a second angle θ2. In other words, the container side wall 31J is oblique to the vertical plane at a second angle θ2 smaller than the first angle θ1. For example, the angle θ2 is set to 30 degrees.

Further, in the present embodiment, when the toner container 30 is mounted in the container mounting section 20H in the second orientation, i.e. when the toner discharge port 30P and the toner supply port 204 communicate with each other (FIG. 17C), a predetermined gap H (FIGS. 16 and 17C) is defined between the container side wall 31J of the toner container 30 and the frame front wall 100H1 of the casing 101. This allows a user to smoothly mount the toner container 30 without touching the frame front wall 100H1 with the fingers that hold the portion of the container flanges 31F lying on the container side wall 31J. In other words, even in the case where a component such as the frame front wall 100H1 is disposed near the toner container 30 in the casing 101, the mounting operation of the toner container 30 can be prevented from being disturbed by the component. Further, a user is allowed to easily insert his/her fingers into the gap H to hold the container flanges 31F in order to dismount the toner container 30. In this manner, in the present embodiment, the container flanges 31F provided for joining the body portion 31A and the lid portion 31B can be used as a holder. The holder allows a user to easily mount the toner container 30.

Further, in the present embodiment, the space defined in front of the exposure deice 123 can be used for disposing the toner container 30. Further, the exposure device 123 and the toner container 30 can be disposed adjacent to each other owing to the support frame 100H, and the mounting and dismounting of the toner container 30 can be easily performed.

Further, in the present embodiment, in order to locate the toner discharge port 30P of the toner container 30 above the toner supply port 204 when the toner container 30 is mounted in the container mounting section 20H in the second orientation, the toner discharge port 30P is formed between the lowest portion of the toner container 30 and the container side wall 31J, and above the lowest portion. This makes it possible to dispose the toner discharge port 30P above the toner supply port 204 without inserting the toner container 30 deep inside the casing 101. If the toner discharge port 30P is formed in the lowest portion of the toner container 30 in FIG. 17C, the toner container 30 would need to be mounted further back (inside the casing 101) in order to locate the toner discharge port 30P above the toner supply port 204. In this case, almost no gap would be left between the toner container 30 and the frame front wall 100H1. Further, it would be difficult to locate the toner container 30 below the top wall 102 because the toner container 30 would be mounted at a position higher than the mounting position shown in FIG. 17C. In the present embodiment, in order to realize a stable supply of toner from the toner container 30 to the developing device 20 while reducing the size of the casing 101, the toner container 30 is mounted in the above-described two steps of having the first orientation and the second orientation. It should be noted that, with reference to FIG. 17C, in order to stably discharge toner accumulating at the lowest portion of the toner container 30 through the toner discharge port 30P, the container paddle 30K (FIG. 11B) that is rotated in the toner container 30 is preferred to be rotated in the direction that allows the container paddle 30K to pass through the lowest portion of the toner container 30 before reaching the toner discharge port 30P. In this case, the toner existing in the lowest portion is reliably raised by the container paddle 30K, so that the amount of toner remaining in the toner container 30 can be reduced.

The toner container 30 and the developer supplier including the same, the developing device 20, and the printer 100 according to the embodiment of the present disclosure have been described. According to the above-described toner container 30, it is possible to provide a developer container that allows easy operation of opening and closing the container shutter 32. It should be noted that the present disclosure is not limited to the above-described embodiment and, for example, the following modified embodiments may be adopted.

(1) In the above-described embodiment, the printer 100 is illustrated as a monochrome printer. However, the present disclosure is not limited to this configuration. In particular, in the case where the printer 100 is provided as a tandem color printer, after the cover 102B (FIG. 16) of the printer 100 is opened, toner containers 30 respectively corresponding to a plurality of colors may be mounted in the casing 101 from above so as to be adjacent to one another.

(2) In the above-described embodiment, the toner container 30 is so mounted in the printer 100 as to extend in the longitudinal direction of the developing device 20. However, the present disclosure is not limited to this configuration. It may be configured such that the toner container 30 is so mounted as to extend in a direction intersecting the longitudinal direction of the developing device 20.

(3) In the above-described embodiment, the container screw 33 and the container paddle 30K are provided in the toner container 30. However, the present disclosure is not limited to this configuration. Alternatively, a movable wall may be disposed in the toner container 30 which moves toward the toner discharge port while conveying toner.

Figure 18:
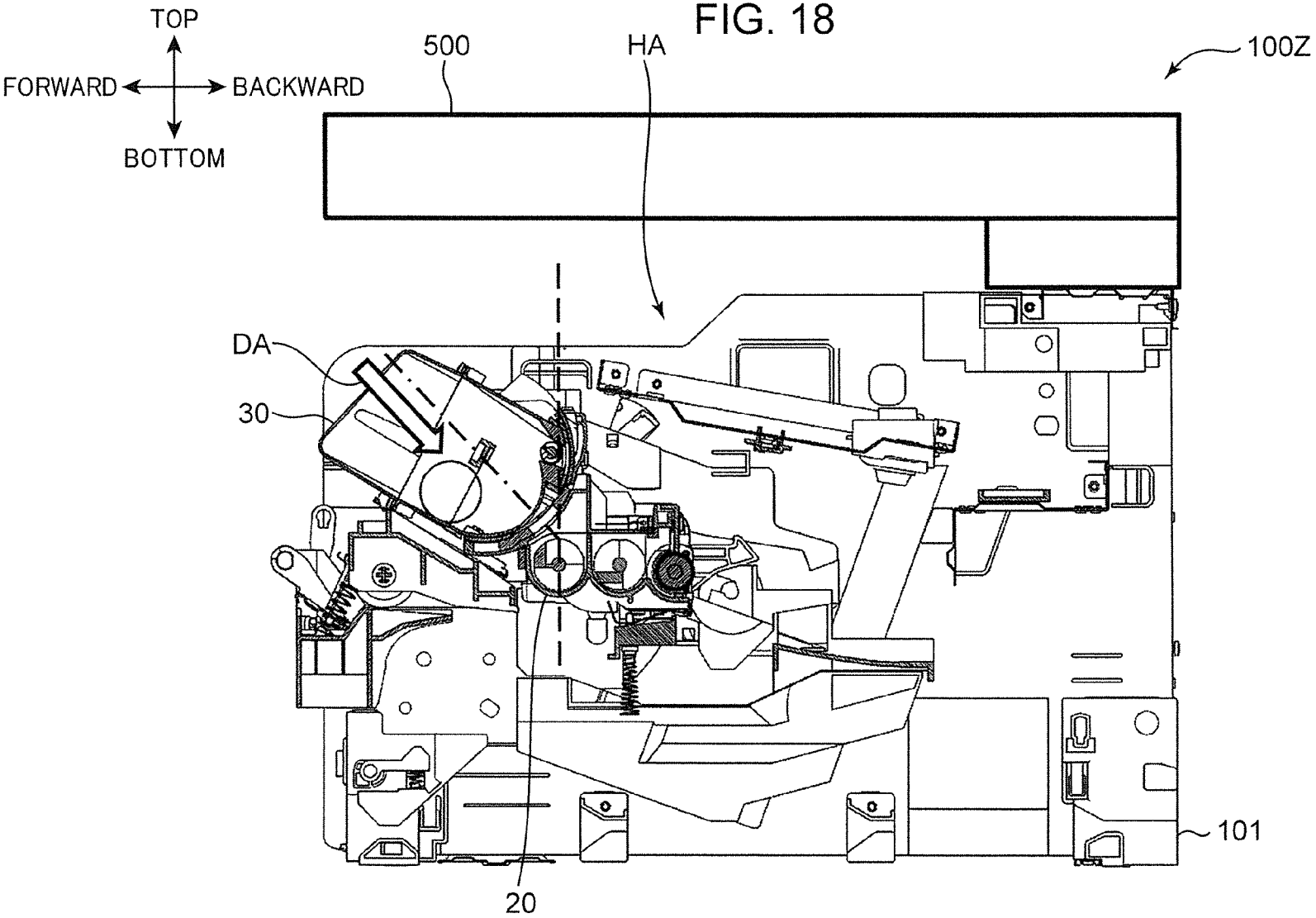
FIG. 18 is a sectional view illustrating mounting of the developer container into an image forming apparatus in a modified embodiment of the present disclosure.

(4) In the above-described embodiment, the image forming apparatus is illustrated as the printer 100. However, the present disclosure is not limited to this configuration. FIG. 18 is a sectional view illustrating mounting of the toner container 30 into a multifunctional apparatus 100Z (image forming apparatus) in a modified embodiment of the present disclosure. The multifunctional apparatus 100Z includes a reading section 500 disposed on the casing 101 of the above-described embodiment. The reading section 500 reads an image of a predetermined original document. The image forming section 120 disposed in the casing 101 forms an image on a sheet in accordance with the original image read by the reading section 500. In this modified embodiment, the reading section 500 extends to a position above a front end of the casing 101. The sheet is discharged into a sheet discharge space HA defined between the casing 101 and the reading section 500. In this case where the reading section 500 extends over the casing 101, the space that is accessible by a user in the mounting of the toner container 30 is limited.

However, even in this case, the toner container 30 is mounted into the developing device 20 in the second direction (in the direction of the arrow DA shown in FIG. 18) extending obliquely to the vertical plane, in the same manner as in the above-described embodiment. Thereafter, the toner container 30 is rotated in the first rotational direction, thereby changing from the first orientation to the second orientation. Thus, it is possible for a user to mount the toner container 30 into the final position by the mounting operation of holding the toner container 30 in the front end side of the casing 101.

(5) In the above-described embodiment, the shutter springs 208 which bias the main unit shutter 22 in the direction to cover the toner supply port 204 are used to bias the toner container 30 in the second rotational direction. The present disclosure is not limited to this configuration. The development housing 200 may be configured to include a dedicated biasing member for biasing the toner container 30 in the second rotational direction, independently of the shutter springs 208 for biasing the main unit shutter 22.

(6) In the above-described embodiment, a lock release portion configured to release the locking of the toner container 30 resting in the second orientation is illustrated as the lock button 202. However, the present disclosure is not limited to this configuration. Alternatively, un unillustrated lever may be pivotally provided in the development housing 200 to allow it to be pivoted to move the locking contact piece 202S so that the locking of the toner container 30 is released.

(7) In the above-described embodiment, when the locking contact piece 202S is moved so that the locking of the toner container 30 is released, the toner container 30 automatically rotates in the second rotational direction owing to the biasing force of the shutter springs 208, thereby returning to the first orientation. However, the present disclosure is not limited to this configuration. It may be configured such that the toner container 30 is rotated in the second rotational direction manually by a user after the locking of the toner container 30 by the locking contact piece 202S is released. In this case, the lock button 202 would have a function to release the locking of the toner container 30 resting in the second orientation to permit rotation of the toner container 30 in the second rotational direction.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

a casing having a cover that is openable and closable;

an image carrier having a surface for allowing an electrostatic latent image to be formed thereon, the image carrier being configured to carry a developed image;

an exposure device configured to form the elastic latent image on the image carrier;

a developing roller configured to supply developer to the image carrier;

a transfer section configured to transfer the developed image from the image carrier onto a sheet;

a developer container configured to contain the developer; and a main unit disposed in the casing and including a mounting section for allowing the developer container to be mounted therein, the main unit being configured to receive the developer supplied from the developer container, wherein:

the developer container includes a container body having a side wall and being formed with a developer discharge port, a container seal surrounding the developer discharge port and made of an elastic material, and a container shutter supported on the container body slidably with respect to the developer discharge port, the container shutter being configured to cover or expose the developer discharge port, the container shutter including a container shutter body, and a container sheet member disposed on a surface of the container shutter body that covers the developer discharge port;

the main unit includes a housing formed with a developer supply port facing the developer container and communicating with an inside of the housing, a main unit seal surrounding the developer supply port and made of an elastic material, a fastening portion configured to secure the container shutter; and a guide mechanism configured so that, when the cover is in an open state and when the side wall of the container body is aligned to extend in a first direction, the guide mechanism guides the container body along a second direction that intersects the first direction and into a position in the mounting section over which the cover can close, and the main unit subsequently allows the container body of the developer container to be rotated in a first rotational direction around an axis extending in the first direction to thereby move and expose the developer discharge port away from the container shutter so that the developer discharge port communicates with the developer supply port, the cover is opened and closed in a state that the developer discharge port communicates with the developer supply port, the second direction referring to a direction extending obliquely downward to a vertical plane at a first angle, and the first rotational direction referring to a direction in which the developer discharge port rotates downward, when the developer discharge port communicates with the developer supply port as a result of the rotation of the developer container in the first rotational direction, the side wall of the developer container is oblique to the vertical plane at a second angle smaller than the first angle, the casing includes a wall portion configured to face the side wall of the developer container when the developer discharge port communicates with the developer supply port, a predetermined gap is defined between the side wall of the developer container and the wall portion of the casing when the developer discharge port communicates with the developer supply port, the main unit allows the developer container to be mounted into the mounting section in a first orientation while being guided in the second direction by the guide mechanism to secure the container shutter to the fastening portion, and subsequently allows the container body of the developer container to be rotated in the first rotational direction around an axis extending in a second direction intersecting the first direction to thereby move and expose the developer discharge port away from the secured container shutter in the first rotational direction so that the developer container changes to a second orientation in which the developer discharge port communicates with the developer supply port, and the container sheet member has a downstream front end in the first rotational direction projecting beyond the container shutter body and having a free end that is configured to come into contact with the main unit seal when the developer container is mounted into the mounting section in the first orientation.

2. An image forming apparatus according to claim 1, wherein the developer discharge port is disposed between a lowest portion and the side wall of the developer container and above the lowest portion.

3. An image forming apparatus according to claim 1, wherein the developer container further includes a holder projecting from the side wall of the container body and configured to be held in the mounting of the developer container in the second direction and the rotation of the container body in the first rotational direction.

4. An image forming apparatus according to claim 3, wherein:

the container body includes a body portion having an opening at a top, and a lid portion mounted on the top of the body portion and defining a storage space for containing the developer in cooperation with the body portion; and the holder is in the form of a flange and is configured to secure the lid portion to the body portion at a joint between the body portion and the lid portion.

5. An image forming apparatus according to claim 1, wherein the housing of the main unit serves as a development housing rotatably supporting the developing roller.

6. An image forming apparatus according to claim 1, wherein the wall portion constitutes a part of a support frame supporting the exposure device.

7. A developer container to be mounted into the main unit of the image forming apparatus according to claim 1, the developer container comprising:

a mounting guide member disposed on the container body and extending in the second direction, the mounting guide member being engageable with the guide mechanism; and a shutter guide member disposed on the container body and supporting the container shutter in such a manner as to allow the container shutter to slide around the axis.

8. An image forming apparatus according to claim 1, wherein the cover is pivoted in the first rotational direction to open.

9. An image forming apparatus according to claim 1, wherein the container sheet member is made of a film.

10. An image forming apparatus according to claim 1, wherein the main unit includes a main unit shutter supported on the housing slidably with respect to the developer supply port, the main unit shutter being configured to cover or expose the developer supply port, and having a main unit shutter body, and a main unit sheet member disposed on a back surface of the main unit shutter body that is opposite to a front surface for covering the developer supply port and that faces the developer container, the main unit sheet member having an upstream front end in the first rotational direction projecting beyond the main unit shutter body and having a free end that is configured to come into contact with the container seal when the developer container is mounted into the mounting section in the first orientation.

11. An image forming apparatus according to claim 10, wherein the container sheet member is made of a film.

12. An image forming apparatus according to claim 10, wherein when the developer container is mounted into the mounting section in the first orientation, the downstream front end in the first rotational direction of the container sheet member comes to rest opposite to and away from the upstream front end in the first rotational direction of the main unit sheet member.

13. An image forming apparatus according to claim 12, wherein when the developer container is mounted into the mounting section in the first orientation, the downstream front end in the first rotational direction of the container sheet member comes into contact with an upper portion of the main unit seal that lies above the developer supply port.

14. An image forming apparatus according to claim 13, wherein when the developer container is rotated from the first orientation to the second orientation in the first rotational direction, the downstream front end in the first rotational direction of the container sheet member covers the upper portion of the main unit seal.

* * * * *